US008784628B2

(12) United States Patent
Grace, Jr. et al.

(10) Patent No.: US 8,784,628 B2
(45) Date of Patent: Jul. 22, 2014

(54) E-COATING METHOD FOR ARCHERY BOW COMPONENTS

(75) Inventors: Louis Grace, Jr., North Street, MI (US); Nathaniel E. Grace, Port Huron, MI (US)

(73) Assignee: Grace Engineering Corp., Memphis, TN (US)

( * ) Notice: Subject to any disclaimer, the term of this patent is extended or adjusted under 35 U.S.C. 154(b) by 229 days.

(21) Appl. No.: 13/547,537

(22) Filed: Jul. 12, 2012

(65) Prior Publication Data

US 2012/0272939 A1 Nov. 1, 2012

Related U.S. Application Data

(60) Continuation-in-part of application No. 12/888,009, filed on Sep. 22, 2010, now Pat. No. 8,424,511, which is a continuation-in-part of application No. 12/646,073, filed on Dec. 23, 2009, which is a division of application No. 12/564,508, filed on Sep. 22, 2009, now Pat. No. 8,371,283.

(60) Provisional application No. 61/102,472, filed on Oct. 3, 2008, provisional application No. 61/253,770, filed on Oct. 21, 2009, provisional application No. 61/292,353, filed on Jan. 5, 2010, provisional application No. 61/322,412, filed on Apr. 9, 2010, provisional application No. 61/322,415, filed on Apr. 9, 2010.

(51) Int. Cl.

| | |
|---|---|
| ***C25D 13/00*** | (2006.01) |
| ***F41B 5/14*** | (2006.01) |
| ***F41B 5/10*** | (2006.01) |

(52) U.S. Cl.

CPC ..... *F41B 5/10* (2013.01); *F41B 5/1403* (2013.01)

USPC ..... 204/471; 204/157.15; 204/157.6; 204/479; 204/487; 204/488; 124/25.6; 124/86; 124/88

(58) Field of Classification Search

CPC ..... C25D 9/02; C25D 21/02; F41B 5/1403; F41B 5/10

USPC ..... 204/509, 157.15, 157.6, 471, 479, 487, 204/488; 124/25.6, 86, 88

See application file for complete search history.

(56) References Cited

U.S. PATENT DOCUMENTS

| | | | |
|---|---|---|---|
| 4,692,382 | A | 9/1987 | Schmitt et al. |
| 4,886,038 | A | 12/1989 | Betters |
| 4,903,678 | A | 2/1990 | Walker |

(Continued)

OTHER PUBLICATIONS

Electrophoretic Deposition, Wikipedia, downloaded from http://en.wikipedia.org/wiki/Electrophoretic_deposition on Jul. 12, 2012.

(Continued)

*Primary Examiner* — Xiuyu Tai

(74) *Attorney, Agent, or Firm* — Warner Norcross & Judd LLP

(57) ABSTRACT

An archery bow is provided including an archery component such as a cable guard and/or cable guide that includes an e-coat film to minimize wear abrasion on a cable, bowstring or other element. A metal surface of an archery component optionally can be immersed in a bath of charged coating particles, and the metal surface can be caused to have an electrical charge. The charged coating particles can be electrodeposited on the metal surface to provide a coating.

11 Claims, 19 Drawing Sheets

(56) References Cited

U.S. PATENT DOCUMENTS

| | | | |
|---|---|---|---|
| 4,917,070 | A | 4/1990 | Townsend |
| 5,002,035 | A | 3/1991 | Brooks |
| 5,392,757 | A | 2/1995 | Head et al. |
| 5,415,149 | A | 5/1995 | Derus et al. |
| 5,553,597 | A | 9/1996 | Sparks |
| 5,651,355 | A | 7/1997 | Gallops, Jr. |
| 5,791,324 | A | 8/1998 | Johnson |
| 5,983,880 | A | 11/1999 | Saunders |
| 6,176,231 | B1 | 1/2001 | Smith |
| 6,425,385 | B1 | 7/2002 | Gallops, Jr. |
| 6,629,522 | B2 | 10/2003 | Andrews |
| 6,655,371 | B2 | 12/2003 | Gallops, Jr. |
| 6,722,354 | B1 | 4/2004 | Land |
| 6,904,900 | B2 | 6/2005 | Gallops, Jr. |
| 8,020,544 | B2 | 9/2011 | McPherson et al. |
| 2010/0282226 | A1 | 11/2010 | Marzullo |
| 2012/0204851 | A1 | 8/2012 | McPherson et al. |

OTHER PUBLICATIONS

Schlesinger, Mordechay; Electroplating, Electrochemistry Encyclopedia, Sep. 2002, downloaded from http://electrochem.cwru.edu/encycl/art-e01-electroplat.htm on Jul. 12, 2012.

E-COATING METHOD FOR ARCHERY BOW COMPONENTS

BACKGROUND OF THE INVENTION

The present invention relates to archery bows, and more particularly to a cable guard and cable guide for archery bows.

Conventional compound archery bows include a bowstring and a set of cables, usually an up cable and a down cable, to transfer energy from the limbs and cams or pulleys (which are both referred to generally as "cams" herein) of the bow to the bowstring, and thus to an arrow shot from the bow. The cables and bowstring are strung from a cam on one limb to a cam on another limb. Typically, the bowstring is positioned very close to the cables due to the configuration of the cams. To avoid interference between the vanes of an arrow shot from the bowstring and the cables, most compound bows include cable guards.

Generally, cable guards provide adequate clearance for arrow vanes or fletchings in the lateral spacing between cables and the plane in which the bowstring travels. The clearance can be achieved by offsetting the cables from the path or plane of the bowstring with the cable guard. Most cable guards include one or more cable guides that work with the cable guard to distance the cables from the cable guard, as well as from one another.

Many cable guards include a bar that extends from the riser of a bow. A cable guide is usually slidably mounted on the bar. The cable guide typically defines two open ended slots, one for receiving an up cable of the bow, the other for receiving a down cable of the bow. Although this construction provides effective cable clearance—that is, it retains the cables in a generally fixed position out of the plane in which the bowstring travels—it presents some shortcomings. For example, most conventional cable guards are rigid and relatively inflexible. Accordingly, when a bowstring is drawn and the cables subsequently become taut, the cable guard (and guide) tends to pull and exert a lateral force component on at least a portion of the cam to which they are attached. This can cause the cams to lean out of vertical alignment. Moreover, in some cases, the limbs of the bow also may twist due to the lateral force. Cam lean and/or limb twist can result in cable wear and possible inconsistent left-to-right shot precision and/or accuracy, which is undesirable. Further, the sliding movement of the cable guide on the cable guard can wear both structures, generate noise, and undesirably complicate the assembly.

Some previous cable guards include a particular configuration to reduce limb twisting and cable wear. Such cable guards include a cable guard rod having a front end and a cable end, where flexibility of the rod increases from the front end to the cable end (where the cables engage the rod). The increase in flexibility is provided via the rod tapering from a large diameter to a small diameter from the front end to the cable end, or by the rod changing from a circular cross section at the front end to a semi-circular cross section at the cable end. In other words, the flexibility is provided by the rod varying in cross section from the riser to the distal tip. While this cable guard construction is designed to reduce limb twist, it is believed that its commercialization generally has been unsuccessful to date. Moreover, because the cross section of such cable guards vary and effectively are reduced toward the end engaging the cables under force, it is believed that they might be prone to excessively deflecting or possibly breaking at that location.

Other cable guard constructions have implemented pulleys that serve as the cable guides. Although this design provides effective cable guidance, it too includes moving parts that must be monitored for wear and surfaces that can cause premature wear or abrasion on the cables.

While conventional cable guards and guides provide decent guidance for cables, there remains a long felt need to provide an archery bow with a simple cable guard and/or cable guide that performs in an efficient and reliable manner, that minimizes leaning of the cam and bow limb twist, and/or that reduces excessive cable wear due to the same.

SUMMARY OF THE INVENTION

In one embodiment, an archery bow is provided including a cable guard and/or cable guide that can flex to selectively move a cable relative to a plane in which a bowstring of the bow travels to minimize cam lean, limb twist, and/or cable wear. The cable guard and/or guide can move toward the bowstring plane as the bowstring is drawn, and away from the bowstring plane, out of the way of the bowstring and an arrow, after the bowstring is released.

In a second embodiment, the cable guard can be contoured so that it flexes a preselected distance in an intended direction. For example, the guard can flex toward a plane in which the bowstring travels, when the cable moves, optionally, when the bowstring is drawn by an archer.

In another embodiment, the cable guard can be constructed from a composite, such as a glass fiber composite. The composite cable guard can include a contoured shape obtained by injection molding. After the molding, the cable guard can undergo secondary machining operations to attain a desired configuration of the guard.

In still another embodiment, the cable guard can be formed using a pultrusion process, followed by secondary machining operations to achieve a desired contour.

In yet another embodiment, the cable guard can be constructed from metal. The cable guard can be contoured and/or dimensioned so that it has suitable flexure and strength-to-weight properties. Such a cable guard can be manufactured by extrusion to the desired contour, followed by secondary machining operations. Alternatively, such a cable guard can be machined from bar stock to include desired dimensions that enable the cable guard to flex in one or more desired locations, and to provide a predetermined amount of flexure and displacement at the cable end of the cable guard.

In even another embodiment, the cable guard can include multiple components. For example, it can include a riser end, a cable end and a flexible central portion therebetween. The riser end and cable end can be generally rigid. The riser end can be configured to mount the cable guard to the riser of a bow. The cable end or opposite end can include or can be joined with any of a variety of cable guides. Optionally, the flexible central portion can be manufactured from a composite, such as a glass fiber composite or similar composite material, or some type of polymer of a desired flexibility. Further optionally, the central portion and riser end can be monolithic.

In still yet another embodiment, the cable guard can include a central portion manufactured from a suitable material in a desired configuration, cross section, and/or dimension. The central portion can be a structural element of desired flexibility joined with the riser end and/or cable end. For example, the element can be a piece of high tensile metal, optionally having an effective yield strength of at least about 35,000 PSI, further optionally at least about 50,000 PSI, even further optionally at least about 75,000 PSI, yet further optionally at least about 100,000 PSI, and still further optionally at least about 200,000 PSI. As another example, the element of the central portion can be music wire of a desired diameter and effective yield strength.

In still yet even another embodiment, the cable guard can define a bore, for example, an elongated bore, extending through it along an axis that is generally parallel to the bowstring when the bowstring is undrawn. The cable guard bore can constrain movement of a cable and generally prevent it from interfering with movement of the bowstring. The cable guard bore can be configured to enable the cable to slide relative to it from an upper surface of the cable guard toward a lower surface of the cable guard.

In a further embodiment, the cable guard bore can include a rounded or radiused opening and/or inner surface to minimize abrasion to the cable as the cable moves as the bowstring is drawn or released. Optionally, the inner surface of the bore, for example an inner wall of the bore, can be highly polished or otherwise treated to further minimize abrasion of the cable as it moves relative to the bore.

In even another further embodiment, the cable guard and/or cable guide can include an inner surface and/or cable-facing surface, which may or may not be part of the cable guard bore, and which can be coated with a material that minimizes, and optionally eliminates, potential for abrasion of the cables and wear in the areas where the cable guard and/or guide engages the cables. The inner surface, as well as any other surface of the cable guard and/or the cable guide (or any other archery component for that matter), can be coated with a material to provide surface properties such as surface smoothness, lubricity, and durability. To achieve these properties, the inner surface and/or other surfaces of the cable guard can be electrocoated (or "e-coated") with an epoxy material or an acrylic material that forms an e-coat film on the inner surface and/or other surfaces of the cable guard and/or cable guide.

In still a further embodiment, the cable guard and/or cable guide can define an elongated bore, through which a cable is positioned, extending in a plane generally parallel to or at an angle to the bowstring plane. The elongation of the bore can be of sufficient length and in such a direction so as not to restrict the generally fore and aft movement of the cable as the bowstring is brought to full draw.

In still even yet a further embodiment, the cable guard can define an elongated bore, through which a cable is positioned, where the elongated bore can include a first and a second end joined by an inner wall. The elongated bore can also define another axis extending from the first end toward the second end. The cable can be positioned in the elongated bore and adapted to slide in a direction leading from the first end to the second end when the bowstring moves.

In yet a further embodiment, a low friction element constructed from materials, such as a ceramics, composites or polymers can be included in the cable guard bore. The low friction element can include a rounded or radiused surface, such as an edge that engages the cable. The low friction element can engage and hold the cable away from the bowstring, while minimizing abrasion and/or friction on the cable. Optionally, the low friction element can be located in a bore, such as an elongated bore, as described above, through which a cable is positioned. Further optionally, the low friction element can include an e-coat film.

In even a further embodiment, the cable guard can define a pair of cable guard bores, each of which can accommodate separate cables of the bow. Optionally, each of the bores can be substantially perpendicular to a longitudinal axis of the cable guard and parallel to the bowstring when it is in an un-drawn state.

In still yet a further embodiment, the cable guard can be configured to provide a controlled degree of flexure in a generally horizontal plane as the bowstring is drawn.

In still even a further embodiment, the cable guard bore can be configured with openings or slots to allow insertion of the cables without the need to un-string the bow.

The archery bow provided herein provides cable guards and/or cable guides that efficiently guide one or more cables of the bow and that can minimize cam lean, reduce limb twist and/or reduce cable wear. Where included, the low friction element also can reduce wear on the cables and therefore increase cable life, as well as improve cable movement and performance.

These and other objects, advantages, and features of the invention will be more fully understood and appreciated by reference to the description of the current embodiment and the drawings.

DETAILED DESCRIPTION OF THE CURRENT EMBODIMENTS

I. Construction and Use

Figure 1:
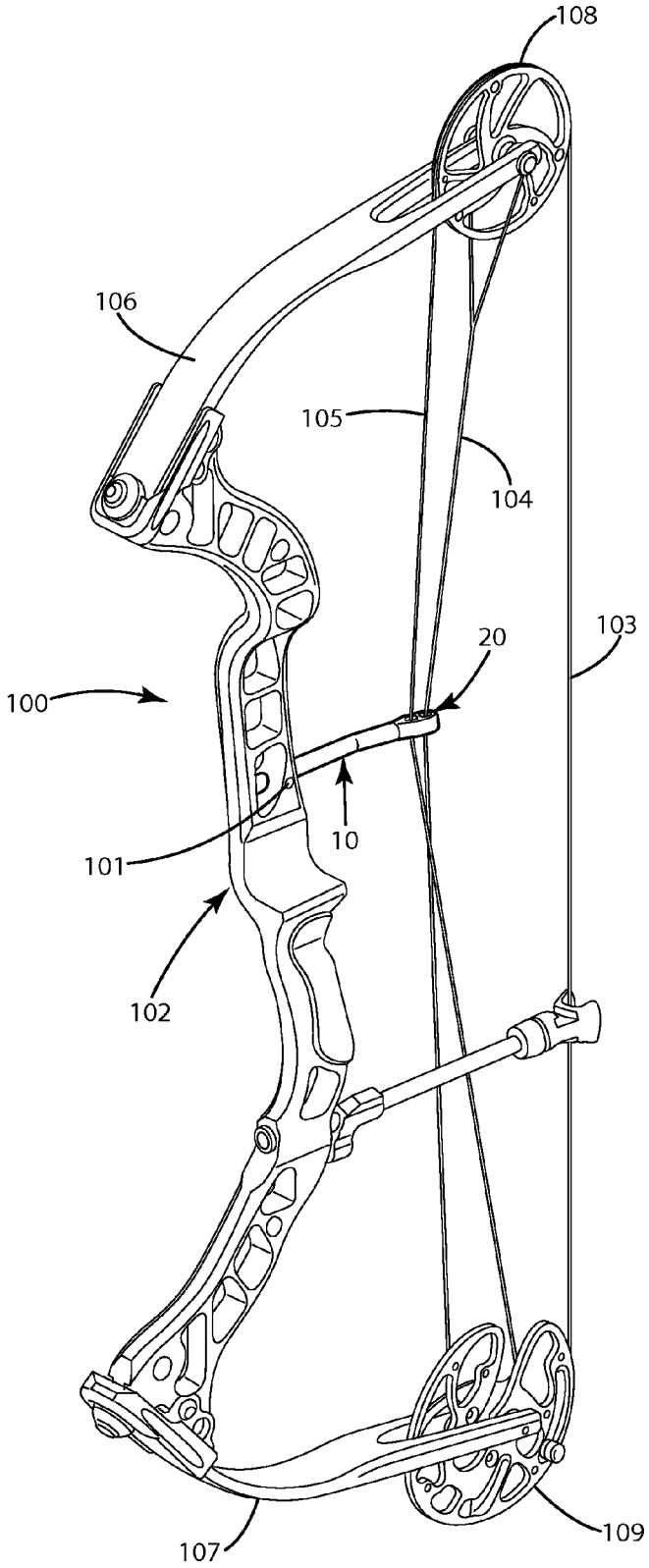
FIG. 1 is a perspective view of a current embodiment of a compound archery bow including a cable guard and cable guides.

FIGS. 1-5 illustrate a current embodiment of an archery bow 100 including a cable guard 10 and a cable guide 20. In general, the archery bow 100 includes an upper limb 106 and a lower limb 107 attached to or otherwise joined with a riser 102. A set of cams 108 and 109, which can either be conventional cams and/or conventional pulleys, are joined with the respective upper 106 and lower 107 limbs. A bowstring 103 is strung around at least a portion of one or more of the cams 108 and 109.

Figure 2:
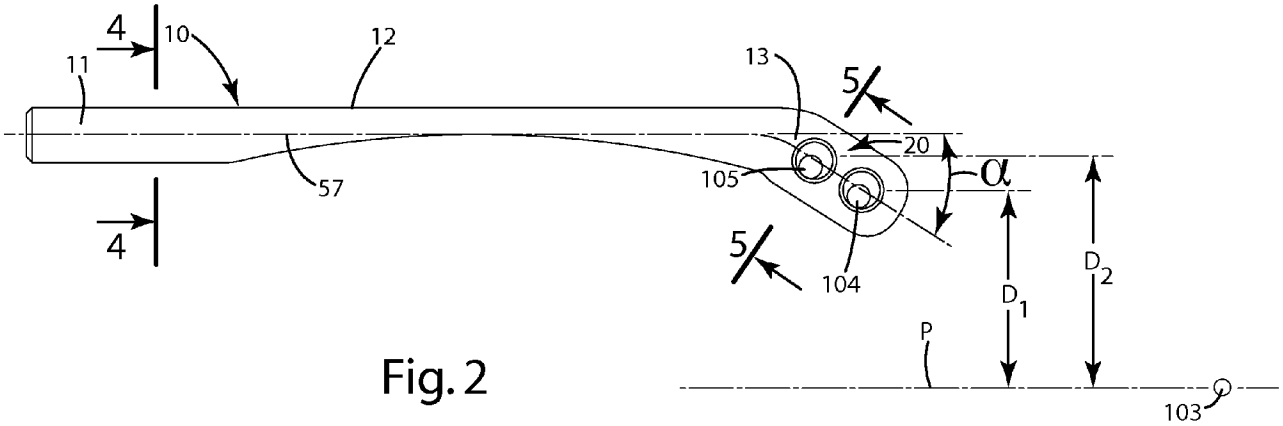
FIG. 2 is a top view of the cable guard and guides.

As shown in FIG. 2, the bowstring 103 moves in a bowstring plane P from an undrawn state to a drawn state and vice versa. The archery bow also includes one or more cables 104, 105, which can be upward moving and/or downward moving cables, depending on the bow type. The bowstring 103 can be joined with the cable 105, which optionally can be a continuation of the bowstring 103. Although shown as a single cam compound archery bow, the current embodiment is well suited for dual cam systems, cam and a half systems, and other systems including a bowstring and one or more cables. Further, although illustrated as a compound bow, the current embodiment can be used in connection with a cross bow, or any bow including a bowstring and a cable.

Figure 4:
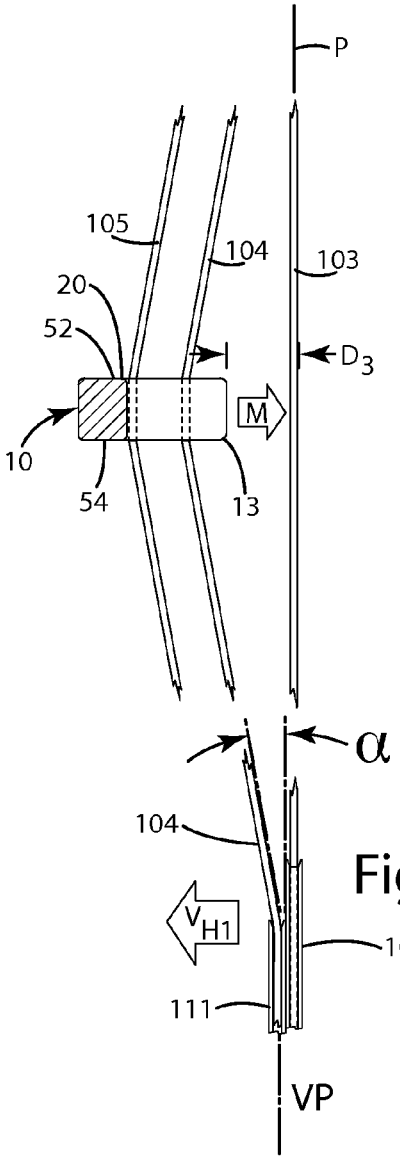
FIG. 4 is cross-sectional view of the cable guard and cable guide taken along line 4-4 in FIG. 2 when the bow is in an undrawn state.

The cables 104 and 105, as shown in FIGS. 2 and 4, are generally held distances $D_1$ and/or $D_2$, which can be equal or different, away from the bowstring plane P to provide for adequate arrow and fletching clearance when the bowstring moves, that is, when or as the bow is drawn and/or released to shoot an arrow from the bow. In general, cable guard end 13 includes a the cable guide 20 engages the cables 104 and 105 to selectively position and/or move a cable relative to the bowstring plane P, that is, the plane in which the bowstring 103 travels, to minimize cam lean, limb twist, and/or cable wear. The cable guard and/or guide can move toward the bowstring plane as the bowstring is drawn, and away from the bowstring plane, out of the way of the bowstring and any attached arrow, after the bowstring is released.

The cables 104 and 105 extend and move through the cable guard bores 22 which can form the cable guide 20 in the cable guard end 13. Optionally, the cable guide can be an integral part of the cable guard end, or it can be a separate component joined with the cable guard. The cable 104 can pass through the bore in the cable guide nearest the plane P of bowstring travel. The other cable 105, which again optionally can be a continuation of the bowstring 103, can pass through the other bore in the cable guide located farthest from the plane P of bowstring travel. Optionally, the cable guide 20 or generally the cable guard bores can be positioned a fixed distance from the riser 102 so that the cables 104 and 105 move generally at that fixed distance as the bowstring 103 moves in plane P. It is noted that while being located at the fixed distance from the riser, the cable guide, cable guard bores, and/or cables can still move relative to the riser as the cable guard flexes, for example, these components can move along a curve, arc or line around a location coinciding with the riser, generally distanced from the riser by one or more radii.

Figure 3:
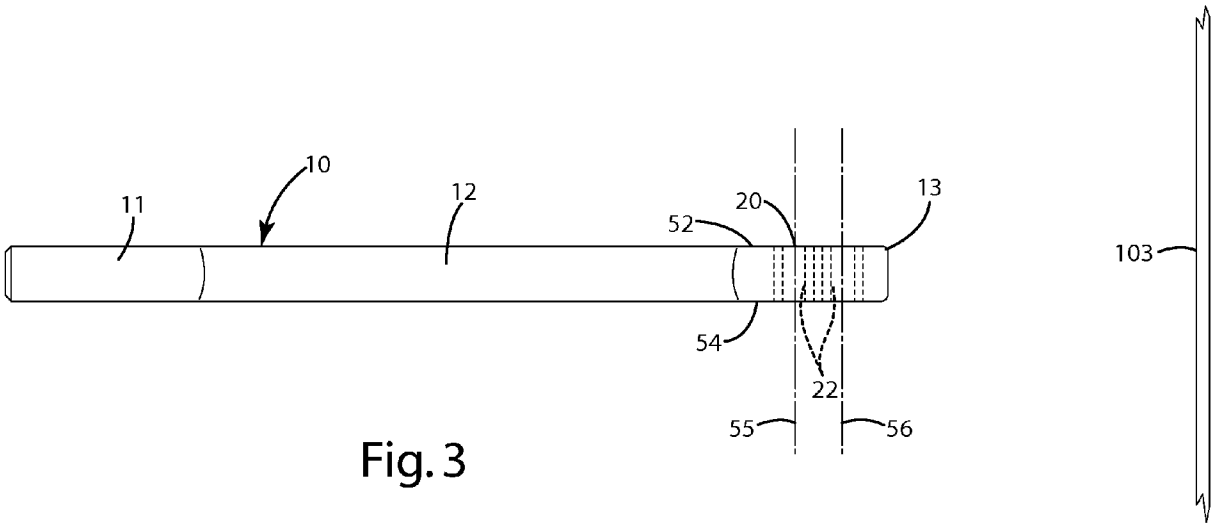
FIG. 3 is a side view of the cable guard and guides.

Referring to the embodiment shown in FIGS. 2 and 3, the cable guard 10, extending from the riser 102, can include a front portion or riser end 11 of uniform cross section, a central section 12 of varying cross section, and a cable portion or cable end 13, where an optional guide element 20 can be located. The riser end 11 can be joined with the riser 102 in a fixed, generally immovable configuration relative to the riser via a set-screw in the riser engaging a bore or flattened recess defined by the riser end 11.

Figure 5:
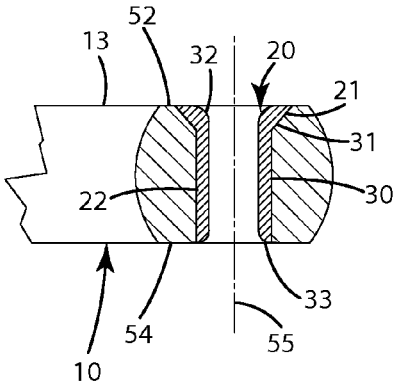
FIG. 5 is a cross sectional view of the cable guard and cable guide taken along line 5-5 in FIG. 2.

The cable end 13 can be cylindrical, elliptical, rectangular or of other geometric cross sections. The cable end 13 or cable guard in general can include and upper surface 52 and a lower surface 54, which optionally can be flattened or contoured continuously with the remainder of the cable guard. The cable end can define the cable guard bores 22 which can form all or part of the cable guide 20. The cable guard bores 22 can extend through the cable guard from the upper surface toward the lower surface or vice versa. Optionally, cable guide inserts 30 (as shown in FIG. 5) can be mounted in the cable guard bores. Generally, the bores 22 each have and axis 54, 56 that can be oriented generally parallel to the bowstring 103 when the bowstring 103 is in an un-drawn state as shown in FIGS. 2-5. The cable guard bores 22 also can include a chamfered opening 21 to better mate with the shoulders or flanges 31 of the cable guide inserts 30.

As shown in FIG. 2, the cable end 13 of the cable guard 10 generally in the form of the guide element 20 can be generally angled relative to the longitudinal axis of the cable guard 10. The guide element 20 can be at an angle $\alpha$ that is optionally about 0 to about 90 degrees, further optionally about 20 to about 50 degrees, and even further optionally about 30 degrees. With this offset angle $\alpha$, the guide element 20 can be positioned to locate the cables 104 and 105 a suitable distance $D_1$ and/or $D_2$ from the plane P in which the bowstring 103 travels. A precise angle $\alpha$ can be selected to accurately position the cables relative to the bowstring travel plane P, and accordingly, to provide clearance for vanes of an arrow shot from the bow 100.

The central portion 12 of the cable guard 10 can be joined with the cable end 13. This central portion can be constructed with an optionally varying cross section in a horizontal plane as seen in FIG. 2 and an optionally non-varying, uniform cross section in a vertical plane as seen in FIG. 3. This configuration of this embodiment can permit the guard 10 to flex in a predetermined manner horizontally while remaining rigid vertically.

The cross section of the central portion 12, however, can be a variety of geometric shapes including circular, triangular, rectangular, hexagonal, diagonal and other shapes as desired. The central portion and the remainder of the cable guard can be formed from a rigid but optionally bendable or flexible material, for example, a composite or metal, optionally titanium, aluminum, magnesium, or other materials. Optionally, the cable guard can have a central region, located somewhere between the riser and the guide end, for example, ¼, ⅓, ½, ⅔, ¾ the distance between these features, that is of a reduced dimension compared to the ends of the cable guard. For example, the central region can have a cross section that is optionally about 5%, 10%, 15%, 20%, 25%, 30%, 35%, 40%, 45%, 50%, 55%, 60%, 65%, 70%, 75%, 80%, 85%, 90%, or 95% the area of cross sections near one or both of the ends. This reduced dimension can enable the cable guard to flex in a predetermined manner, thereby reducing the potential for one of more of the cams to lean out of vertical alignment. By leaning out of vertical alignment, it is meant that a part or all of a cam deviates from or becomes angled relative to the plane VP shown in FIGS. 4 and 4A, which is established when the bow is held in a normal, substantially vertical shooting orientation by an archer.

As yet another option, the materials used to construct the cable guard can be selected and/or combined in a way so that the resulting cable guard flexes slightly toward the plane in which the bowstring travels, as will be described in below embodiments. With this flexing cable guard construction, the potential for one or more of the cams to lean out of vertical alignment can be reduced if desired. In some cases, all or part of the cam can become angled relative to the bowstring plane P as well when the cam is out of vertical alignment.

Figure 4A:
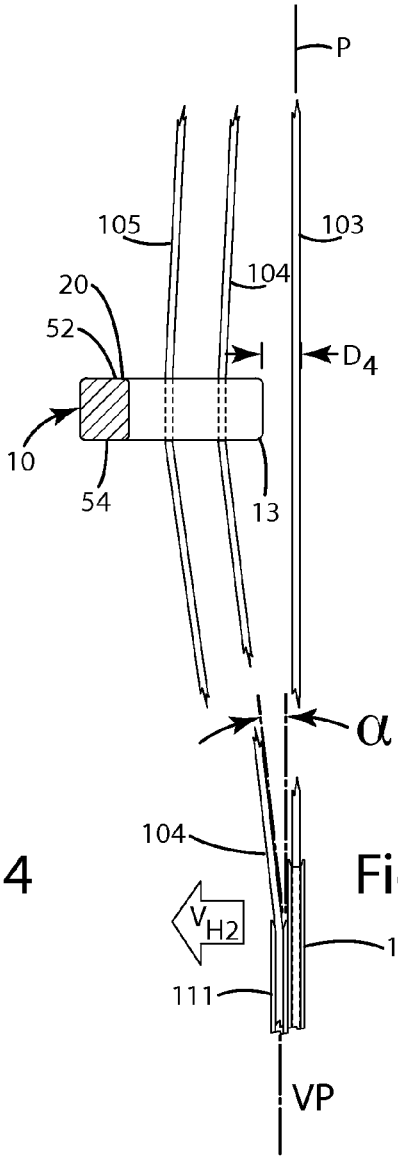
FIG. 4A is a cross sectional view of the cable guard and cable guide taken along line 4-4 in FIG. 2 when the bow is in a drawn state.
Figure 4B:
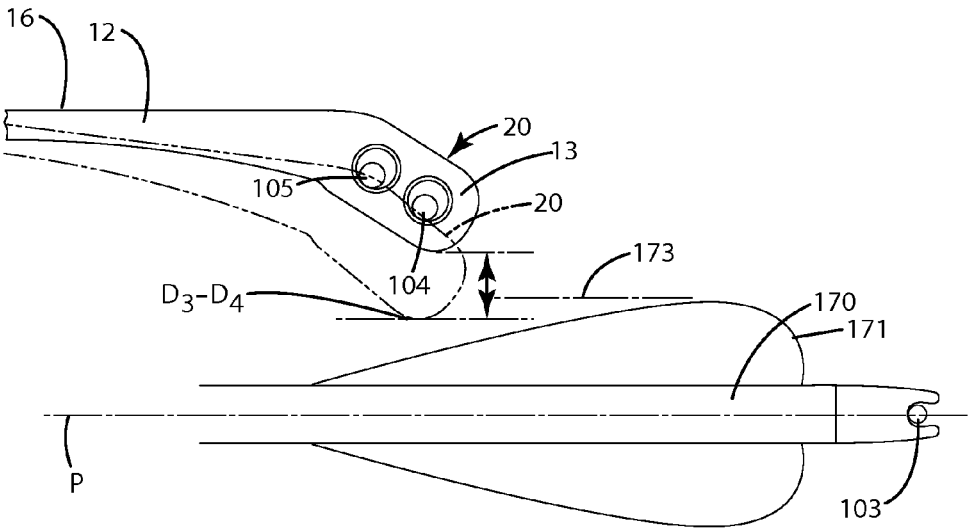
FIG. 4B is a top view of the cable guard and cable guide illustrating flexing of the same.

As shown in FIGS. 4, 4A and 4B the cable guard end 13 and in general the cable guide 20 are adapted to selectively move toward and away from the plane P in which the bowstring 103 travels. Generally, this movement is accomplished by a flexing or bending of the cable guard 12 at some portion thereof. In turn, this flexure enables the cables 104 and 105 to move toward the plane P of the path of the bowstring 103 as the bowstring, and thus the bow, is drawn to a full draw position by an archer. As bowstring is drawn, the cables and guard move laterally toward the bowstring plane P. As explained below, the movement of the cables 104 and 105 toward the plane P can reduce the magnitude of the horizontal vector of the forces imparted to the cams 108 and 109 by the cables 104 and/or 105, which can result in a reduction in cam lean, and a reduction of twisting forces impacted on limbs 106, 107, as well as a reduction in wear on cables 104, 105. In some cases the reduction can be so significant that cam lean can be substantially eliminated.

An example of the flexing effects of the cable guard is shown in FIGS. 4, 4A and 4B. FIG. 4 illustrates the relative orientations of the cables 104 and 105 and the bowstring 103 when the bowstring is at rest and when the bowstring is in an undrawn state. This figure also can provide a general idea of the relative orientations of these elements after the bowstring is released and is returning or has returned to the undrawn state.

As can be seen in FIG. 4, the cable guard end 13 is a distance $D_3$ from the bowstring plane P. Cables 104 and 105 are respectively at distances $D_1$ and $D_2$ (FIG. 2) from bowstring plane P as well. Even in the undrawn state shown in FIG. 4, the cables, for example, cable 104 exert a horizontal force vector $V_{H1}$ on the cam 109.

As the bowstring 103 is drawn or approaches its fully drawn state as shown in FIG. 4A, the cable guard, and optionally the central portion thereof, flexes or bends, and the cable guard end 13, guide 20 and portions of the cables 104, 105 contained in the guide and/or cable guard end move in the direction of arrow M so that these components, are displaced laterally, or generally transversely relative to the bowstring 103. In so moving, these components move in a direction toward the bowstring plane P as the bowstring is drawn or when it reaches a fully drawn state. Thus, the cable guard end, guide and/or cable moves to a distance $D_4$ from the bowstring. This distance $D_4$ can be less than distance $D_3$. The difference between $D_3$ and $D_4$ can optionally range from a lower limit of about 1/16", ⅛", ¼", ½", ¾" or 1" to an upper limit of about ⅛", ¼"½"¾", 1", 1¼", 1½", 1¾", 2", 2¼", 2½", or 3". This difference can further optionally range from about 0.25 inches to about 2.0 inches, even further optionally about 0.25 to about 1.75 inches, and yet further optionally at least about 0.25 inches. The difference can equate to the distance that the cable end, cable guide and/or cable associated with the guide moves as the cable guard flexes toward or away from the bowstring plane.

With the bowstring fully drawn, the cables 104 and 105 are under a greater overall load. In turn, this loading of the cables exerts a greater horizontal force vector $V_{H2}$ on the cam 109. Due to the guard/guide and cables moving toward the bowstring plane in the direction of arrow M, this horizontal force vector is decreased relative to the horizontal force vector that would be exerted if the cable guard/guide and cables had not moved. Accordingly, there is less tendency for the portion 111 of the cam (closer to the cable guard) to be pulled laterally, and thus less tendency for the cam 109 to lean out of vertical alignment. Overall, this results in a reduction of cam lean. Further, because the horizontal force vector is reduced and/or eliminated, rotation and twisting of the limbs (due to a moment arm created by a component of the force vectors on the cam) is reduced.

Additionally, the flexure of the cable guard 12 in any embodiment herein also can reduce cable wear due to the smaller angle at which the cable might come off the cam 109. For example, due to the flexing of the cable guard, the angle $\alpha_2$ at which the cable comes off the cam 109 (FIG. 4A), when the bowstring is being drawn or fully drawn, can be reduced. For example, in comparing angle $\alpha_1$ in FIG. 4 to angle $\alpha_2$ in FIG. 4A, it is evident that $\alpha_2$ is less than $\alpha_1$. In some cases, $\alpha_2$ optionally can be less than $\alpha_1$ by 0.5, 0.75, 1, 1.25, 1.5, 1.75, 2, 3, 4, 5, 10, 15, 20 degrees, or more or less depending on the configuration of the components. Accordingly, even while the cables are under a greater load in FIG. 4A, the cables are more aligned with the cam, which can reduce cam lean, and can reduce cable wear where the cables engage the cam.

The cable guard 12 can define a longitudinal axis 57, which can extend from the riser end 11 toward the cable end 13 as illustrated in FIG. 2. This longitudinal axis need not necessarily be located perfectly centrally relative to the guard and the other components. If desired, the cable end 13 and cable guide 20 can be immovable along the longitudinal axis so that the cable end 13 and cable guide 20 generally do not move toward or away from the riser end 11 on paths substantially parallel to or along the axis 57 as the bowstring moves or the bow is otherwise manipulated by an archer. In general, flexing or bending of the cable guard 12 and corresponding movement of the cable end 13, cable guide 20 and/or cables 104, 105 toward or away from the bowstring plane P are not considered movements of those elements or other elements along the longitudinal axis 57. Moreover, where the cable guard is joined with a cable guide including one or more pulleys or spools, as described in embodiments below, the movement of those elements, for example, rotation of the pulleys or spools, is not considered movement along the longitudinal axis 57.

Optionally, as shown in the various embodiments herein, the cable guide can be non-slidably joined with the cable guard end, or with the cable guard in general. Accordingly, the cable guides do not slide with the cables 104, 105 along any portion of the cable guard or its components, or more generally along the longitudinal axis 57. They may, however, rotate relative to those components but still be considered non-slidably joined relative thereto. Of course, if desired, the cable guides herein could be modified to be slidable relative to certain components in certain applications.

Returning to the cable guides, FIG. 5 shows one configuration of a low friction insert 30 of the cable guide 20. In this configuration, the insert 30 is provided with substantial radii 32 and 33 at the entrance and egress surfaces. The large radii can reduce wear on the cables 104 and 105 as they move through the inserts 30. Where included in the cable guard bore 22, the insert 30 can be introduced into the top of the bore 22 of the cable guide 20 and pressed downward until the external chamfer 31 of its flange contacts the internal chamfer 21 of the guide 20. The top surface of the insert 30 can be flush with the upper surface 52 of the cable end 13 and/or guide 20. The insert 30 can be retained in the cable guard bores 22 or generally in the guide 20 simply by friction fit. Optionally, where the insert 30 is of a fragile material such as a ceramic, retention may be achieved by some form of an adhesive such as, but not limited to, an epoxy.

Optionally, the cable guard 10 can be constructed at least in part from a suitable composite material by injection molding to the contoured shape or, further optionally, using a pultrusion process followed by machining to the desired contour. Suitable composite materials may include, but are not limited to, fiberglass, carbon/graphite, urethane or other suitable synthetic materials or polymers. Alternatively, the cable guard may be constructed from a metal with suitable flexure and strength to weight properties, such as, but not limited to titanium. A metal cable guard may be manufactured by extrusion to the desired contour with secondary machining operations, or by any other feasible manufacturing process.

In the current embodiment, as illustrated by FIGS. 2-5, the riser end 11 of the guard 10 engages a rectangular slot, optionally of corresponding size, in the riser 102. In this embodiment, the guard may be secured in the riser 102 by a set screw 101.

FIG. 5 illustrates a cross section of the cable end 13 of the cable guard 10, illustrating the assembly of a low friction insert 30 in the bore 22 of the guide element 20. This insert can be molded from a ceramic material, optionally, a glazed ceramic material, such as a glazed porcelain. Other suitable low friction materials include, but are not limited to, polymers, such as polyethylene, polytetrafluoroethylene, or polyvinylchloride, low friction composites, polished metals, or other materials that provide a sufficiently low coefficient of friction and suitable resistance to wear. Optionally, where the cable guard 10 is constructed of metal, highly polished cable guard bores 22 of the cable guide 20 can function without inserts.

Optionally, the insert 30 can be slightly friction-fit within the cable guide bore 22 as desired. The insert 30 can be secured to the cable guard 10 by including an adhesive within the cable guard bore 22 before insertion of the insert. The adhesive can adhere the insert directly to the cable guard bore 22 in a fixed and immovable position. A variety of other mechanisms can be used to fixedly and immovably join the insert 30 in the cable guard bores 22 or generally to the cable guard 10. For example, a set screw can be included in the cable guard 10 to gently engage the insert 30 and hold it in place. As an example, the exterior surface of the insert 30 can be threaded, and can thread into corresponding threads in the cable guard bore 22. As another example, the insert can be moveably mounted in the cable guard bore. For example, it can be rotatably mounted in the bore, held in place by a groove or other locking structure, which permits the insert 30 to rotate in the bore, but not be extracted or removed from the bore during usual movement of the cables.

In the current embodiment illustrated in FIGS. 1-5, the cable guard 10 can remain in a generally fixed vertical position relative to the riser 102 whether the bow is at rest or in the drawn state. However, when the bowstring 103 is drawn, the reduced cross-section of the center portion 12 of the guard 10 permits a certain generally horizontal and/or lateral, movement of the cable end 13 and optionally any associated guide and cable toward plane P of the bowstring travel. This movement, which is illustrated by arrow M in FIG. 4 is the result of the lateral force imparted to the cable guide 20 through the guide bores 26, or optional guide inserts 30, by the cables 104 and 105 as the bowstring is drawn. The controlled flexure of the cable guard 10 and hence the cable guide 20 enables can absorb (by bending or flexing) at least a portion of the lateral force imparted by the cables 104 and 105 as the bowstring is drawn by a user. Again, this reduces the lateral forces, for example $V_{H2}$ in FIG. 4A, applied to the cams and/or pulleys 108 and 109 and decreases the potential for cam lean, limb twisting, and/or cable wear. The designed flexure of the cable guard notwithstanding, when the cables are under extreme tension along the draw stroke, the cable end 13, cable guard bores 22 and cable guide 20 can still be considered to be held at a fixed distance from the riser 102.

As shown in FIG. 4B, the configuration, shape, cross section and/or material of the cable guard 20, optionally the central portion 16, can be selected to enable the cable end, the guide and the cables to horizontally or laterally move a preselected distance $D_3$-$D_4$ toward the bowstring plane P when the bowstring is drawn. Generally, when the bowstring is drawn, the cables 104 and 105 come under additional tension, and force the cable end, the guide and the cables toward the bowstring plane P. As this occurs, the guard center portion 12 flexes or bends. The cable end, the guide and the cables, when under such force, can move the distance $D_3$-$D_4$, which can place cable end, the guide and/or the cables, or at least a portion thereof, in the path 173 of the arrow fletchings 171, or more generally of an arrow 170 when moved by the bowstring. This movement and the resulting path can correspond to the bowstring being released, and the arrow 170 beginning to follow a trajectory as it is shot from the bow 100.

Due to the configuration, shape, cross section and/or material of the cable guard 10, when the bowstring is released, the cable end 13, guide 20 and cables 104, 105 can travel generally laterally the preselected distance $D_3$-$D_4$ away from the bowstring plane P. This movement over the distance $D_3$-$D_4$ removes the cable end 13, guide 20 and cables 104, 105 from the path 173 of the arrow fletchings 171, and generally from the path of the arrow 170, as the arrow 170 is moved by the bowstring 103 and as the arrow 170 moves past these components. Accordingly, the cable guard, guide and cables do not interfere with the flight of the arrow 170.

Generally, the cable guard and guide are constructed so that when the bowstring 103 is drawn in the bowstring plane P, forces are transferred from the bowstring 103 to the cables 104 and 105. These forces cause the cable guide 20 to move a distance $D_3$-$D_4$ toward the bowstring plane. The fletchings 171 the arrow 170, however, are unaffected by this movement, and generally are unengaged by the cable end 13, guide 20 and cables 104, 105 because those fletchings 171 are disposed rearward of these components, generally near the bowstring which is drawn a distance away from the cable guard and guide.

When the bowstring 103 is released, the forces within the cables 104 and 105 are transferred back into the bowstring 103 to propel the arrow 170 forward. A reduction in forces in the cables enables the cable guard 12 to revert or flex to its previous configuration, and thereby move the cable guide 20 away from the plane P in which the bowstring 103 moves. In effect, the cable guide 20 can move a distance $D_3$-$D_4$ away from the bowstring plane P. This movement of the cable guide 20 can occur before the fletchings 171 of the arrow pass the cable guide 20. Accordingly, the cable guard end, cable guide, as well as the cables 104 and 105, generally do not interfere with the flight of the arrow 170, or its exit from the bow 100.

The foregoing description of the flexing or bending of the cable guard 10 in the current embodiment is likewise applicable to all of the various alternative embodiments described herein.

II. Assembly

A current embodiment of the archery bow 100 can be assembled as follows. The cable guard 10 can be joined with the bow 100 by inserting the riser end 11 of the cable guard 10 into an opening located in the riser 102 of the bow 100. This opening can be located above the handle, in the offset portion of the riser 102, adjacent the shelf of the riser. Of course, the cable guard 10 can be installed either above or below the shelf, and/or the handle of the riser.

The cable guard 10 can be positioned such that the cable guide 20 positions the cables 104 and 105 to achieve the desired clearance from the bowstring plane P, and more generally, achieves the desired clearance of vanes and/or arrows being shot from the bow so that the cables do not interfere with the flight of the arrow.

Figure 6:
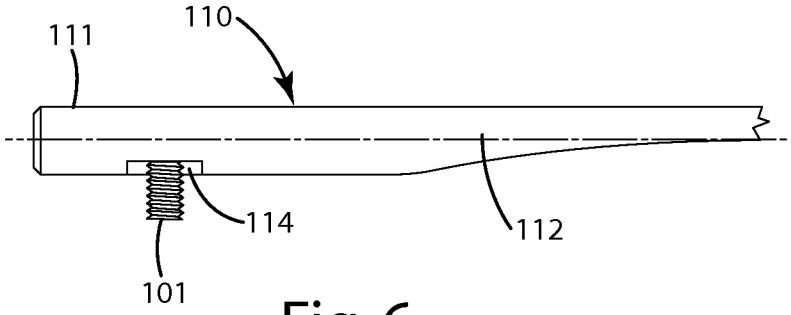
FIG. 6 is a partial top view of the first alternative embodiment of the cable guard.
Figure 7:
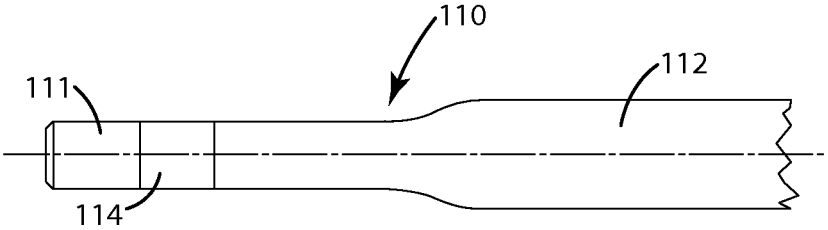
FIG. 7 is a partial side view of the first alternative embodiment of the cable guard.
Figure 8:
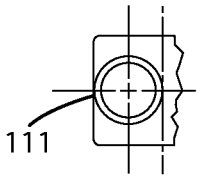
FIG. 8 is a partial end view of the first alternative embodiment of the cable guard.

With the cable guard 10 positioned, it can be secured via a set screw 101 or other fastener that engages the cable guard 10 and holds it in a fixed position relative to the riser 102 (FIGS. 6-8). As desired, the cable guard 10 and cable guide 20 can be readjusted to ensure desired placement of the cables and adequate arrow vane clearance.

The bowstring 103 and cables 104 and 105 with their respective cams can be assembled in a variety of manners. In one, each of the two cables 104 and 105 include looped ends that are designed to attach to anchor posts on the cams 108, 109. After attaching the cable guard 10 to the riser 102 of the bow 100, and before stringing the bow, the loop ends of each of the cables and/or bowstring can be inserted through the cable guard bores of the respective guide 20 and/or optional guide insert 30. It is noted that generally as the bow 100 is drawn, the cables 104 and 105 move in opposite directions. For example, the cable 105 moves upward, and the cable 104 moves downward. The upward cable 105 can be inserted into the guide bore distanced the farthest from the bowstring travel plane P. The downward traveling cable 104 can be positioned in the cable guide bore that is closest to the bowstring travel plane P as shown in FIGS. 2 and 4A.

Optionally, the cable guard end 13 and/or cable guide 20 can be constructed with an opening that permits insertion of the cables 104 and 105 through the bores 22 after the bow 100 has been strung and the cable guard 10 mounted in position. Such an embodiment is described below in connection with FIG. 31. Generally, the opening, in the form of a vertical slot, can be located in the portion of the cable end 13 facing away from the bowstring plane P. Where included associated inserts 30 also can be provided with corresponding slots aligned with the bores in the above noted portions of the cable end. In such an embodiment, the cables can be inserted through the slots into the cable guard bores.

After being assembled, the bow 100 can be shot to confirm that the cable guard provides the desired amount of flex or bending in the cable guard, and so that the cable guide moves toward and away from the bowstring plane in a highly synchronized manner. One objective of such confirmation can be to ensure that the cable guard end, guides, and/or cables move a distance described above toward the bowstring plane P as the bowstring 103 is drawn to reduce the potential for the cams to move out of vertical alignment after the bowstring is drawn. Another objective can be to confirm that the cable guard end, guides, and/or cables move away from the bowstring plane P after the bowstring 103 is released so that these elements do not interfere with the flight of an arrow moved by the bowstring, for example, by engaging a fletching of the arrow. If the components of the cable guard do interfere with the flight of the arrow, then the cable guard can be iteratively adjusted or moved to change the location of or amount or rate of flexure of the cable guard when the bowstring is moved. Optionally, the location of the cable guard end and/or cable guide can be adjusted away from or toward the bowstring plane depending on the problem.

In many cases, it has been observed that in addition to the above mentioned benefits, the cable guards herein can reduce the amount of yaw, that is, side to side wobble, of a bow, which in turn can reduce unintentional left or right horizontal arrow drift off an intended target location when an arrow is shot from the bow. In other cases, it has been observed that the forces the cable guard herein exert against the cables throughout the shot cycle can absorb or dampen excessive vibration that is normally encountered. In turn, this can provide less hand shock, and improve the accuracy of the archer.

III. First Alternative Embodiment

FIGS. 6-8 illustrate the first alternative embodiment of the cable guard generally designated 110. This embodiment is similar to the above embodiment in structure and operation with a few exceptions. For example, the riser end 111 is circular in cross section and is provided with a flattened section or notch 114. A set screw 101, threaded in the riser 102, engages the notch 114 to retain the cable guard 110 in a fixed, generally immovable configuration relative to the riser. Other mechanisms can be used to secure the cable guard 110 to the bow 100. For example, the cable guard 110 can be threaded on its riser end 111 which can engage a corresponding threaded hole in the riser 102. Other optional fasteners, such as clamping devices, can be included on the riser, and can hold the cable guard 110 fixedly joined with the riser 102.

IV. Second Alternative Embodiment

Figure 9:
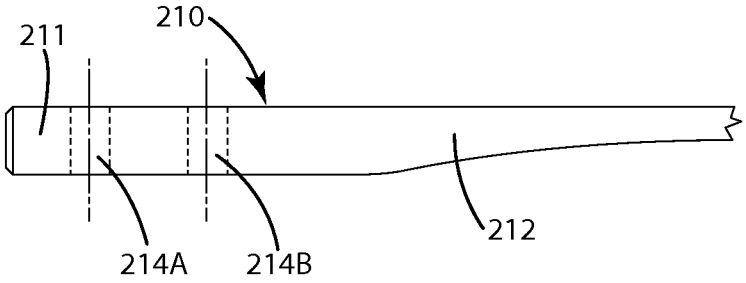
FIG. 9 is a partial top view of a second alternative embodiment of the cable guard.
Figure 10:
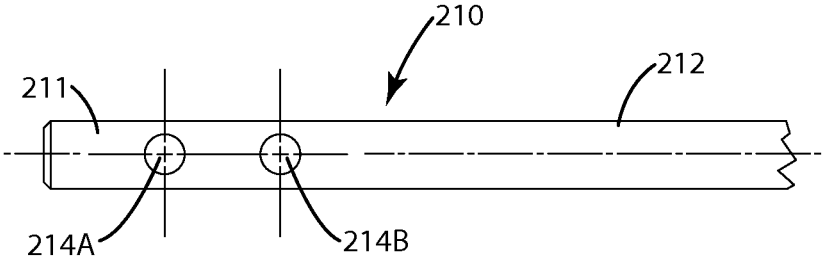
FIG. 10 is a partial side view of the second alternative embodiment of the cable guard.
Figure 11:
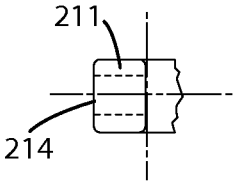
FIG. 11 is a partial end view of the second alternative embodiment of the cable guard.

FIGS. 9-11 illustrate the second alternative embodiment of the cable guard generally designated 210. This embodiment is similar to the above embodiments in structure and operation with a few exceptions. For example, the riser end 211 is rectangular in cross section and is provided with two through, or optionally threaded, holes 214A and 214*b* for the purpose of mounting and securing the guard 210 to the side of the riser 102. Depending on the configuration of the holes in the two members, the guard 210 may be mounted to the riser 102 using either screws or bolts. Optionally, the guard 210 may be secured by other fasteners such as bolts positioned in corresponding through holes in the riser 102 and the front portion 211 of the guard 210. Optionally, screws or similar devices may be used, positioned in through holes in either the riser 102 or the front portion 211 of the guard 210 and engaging threaded holes in the opposite member.

V. Third Alternative Embodiment

Figure 12:
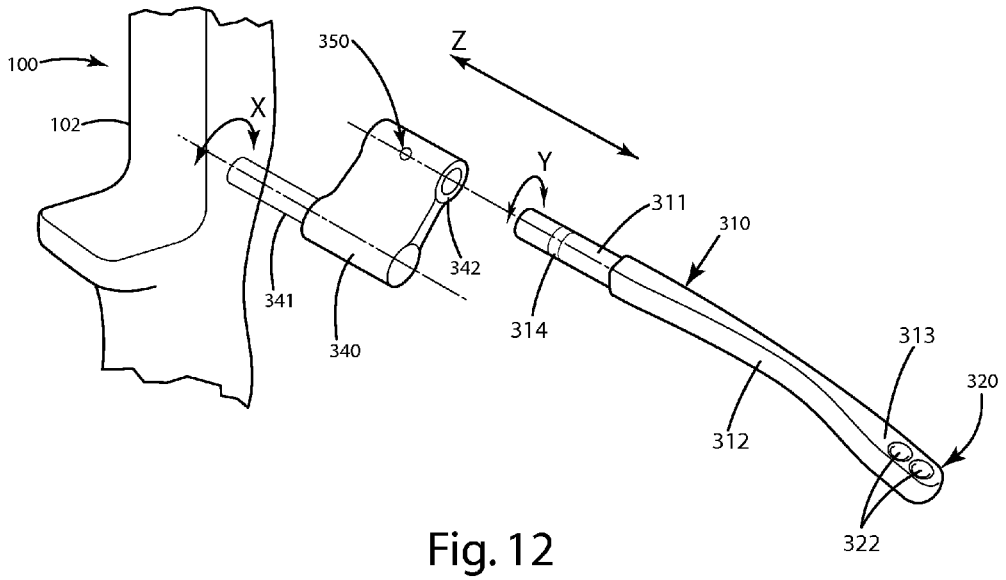
FIG. 12 is a perspective view of a third alternative embodiment of the cable guard and cable guide including an adjustable mounting bracket.

A third alternative embodiment of the cable guard is shown in FIG. 12 and generally designated 310. This embodiment is similar to the above embodiments in structure and operation with a few exceptions. For example, this cable guard 310 is joined with a mounting bracket 340. The mounting bracket 340 includes a boss 341 adapted to be inserted into a bore of the bow riser 102. Optionally, the boss 341 can be held in the bore of the riser 102 by a set screw as described above, or other fasteners. The mounting bracket also can include an offset portion 342 that extends away from the boss 341. This offset portion 342 can define a bore 343 and, optionally, a threaded hole that accepts a set screw 350 for retaining the cable guard 310 in the mounting bracket 340. The axis of this bore 343 can be offset from the axis of the boss 341. The bore 343 can be sized to provide a slip fit for the riser end 311 of the cable guard 310.

Movement in the directions shown by the arrow Z, toward and away from the riser 102, can be achieved by sliding the boss 341 of the mounting bracket 340, fore and aft, in its corresponding bore in the riser 102 prior to securing it in its desired position. Optionally, movement in the Z-axis may be achieved by sliding the riser end 11 of the guard 310 within the bore 343 of the mounting bracket 340. When it is desirable to maintain the cable guard 310 in an essentially fixed position along the Z-axis relative to the bore 343 of the mounting bracket 340, an annular groove 314 can be defined in the riser end 311 of the cable guard 310 to accept the set screw 350 in the mounting bracket 340.

With the mounting bracket, the cable guard 310 also can rotate in the directions shown by arrow Y in the bore 343. In addition, the boss 341 can rotate relative to the riser 102 and/or the bracket 340 in the directions shown by arrow X. The offset of the two axes of the bracket 340 provides rotation in two planes, as illustrated by arrows X and Y.

Mounting of this embodiment to the riser may be accomplished by any of the structures described above. Similarly, the guide of this embodiment may include any of the structures described herein, and the operation of this embodiment can be similar to any of the embodiments herein.

VI. Fourth Alternative Embodiment

Figure 13:
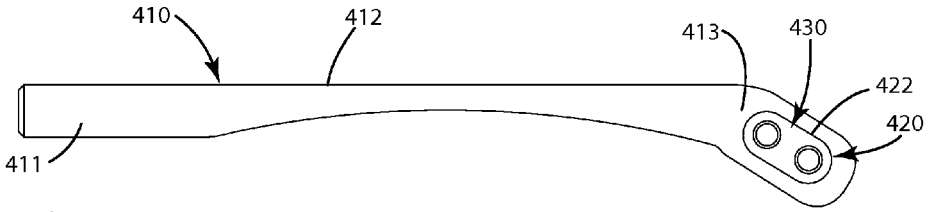
FIG. 13 is a top view of a fourth alternative embodiment of the cable guard and cable guides.
Figure 14:
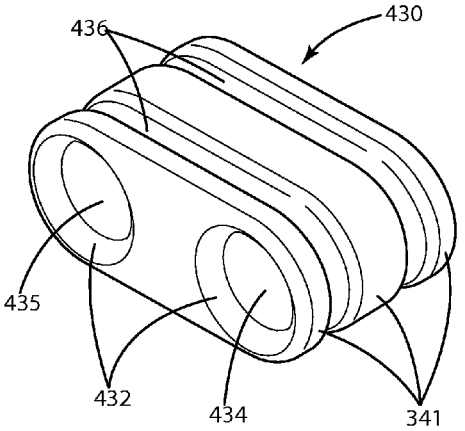
FIG. 14 is a perspective view of a cable guide insert of the fourth alternative embodiment of the cable guard and guides.

A fourth alternative embodiment of the cable guard is shown in FIG. 13 and generally designated 410. This embodiment is similar to the above embodiments in structure and operation with a few exceptions. For example, the cable end 413 defines a single cable guard bore 422 which can function as the cable guide, and which optionally can receive a cable guide insert 430. Referring to FIG. 14, the cable guide insert 430 can define bores 434 and 435 through which the cables 104 and 105, respectively, move. The entrances 432 and exits 433 (not shown) of the bores 434 and 435 can be configured with chamfers or substantial radii to reduce wear on the cables and to facilitate cable insertion. The outer surface 431 of the insert 430 can be sized to fit the opening 422 of the cable guide 420. Where the insert 430 is manufactured from a fragile material, such as a ceramic, the insert can be retained in the bore 422 via a light press or slip fit. Optionally, grooves 436 can be provided in the surface 431 for adhesive application for insert retention. Further optionally, "O" rings can be inserted in the grooves 436 to retain the insert in the bore and/or reduce cable induced vibrations and resulting noise.

Mounting of this embodiment to the riser may be accomplished by any of the structures described above. Similarly, the guide of this embodiment may include any of the structures described herein, and the operation of this embodiment can be similar to any of the embodiments herein.

VII. Fifth Alternative Embodiment

Figure 15:
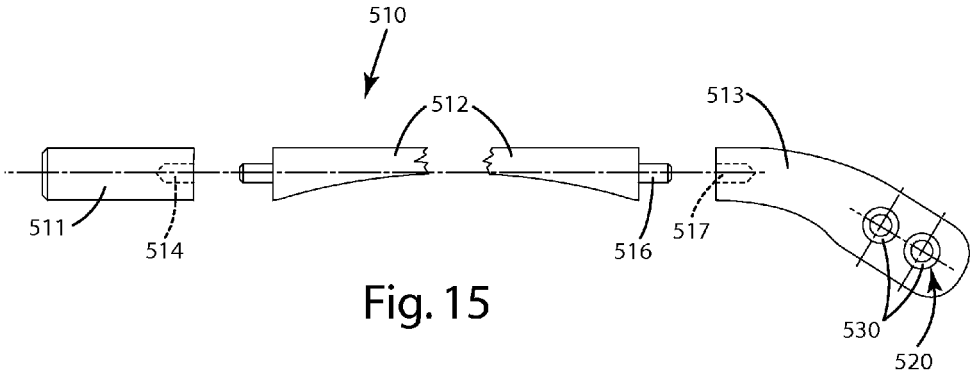
FIG. 15 is an exploded fragmented top view of a fifth alternative embodiment of the cable guard and guides.

A fifth alternative embodiment of the cable guard is shown in FIG. 15 and generally designated 510. This embodiment is similar to the above embodiment in structure and operation with a few exceptions. For example, the cable guard 510 includes a rigid riser end 511, a rigid cable end 513 and a flexible central portion 512. The flexible central portion 512 may be manufactured from, but not limited to, a glass fiber composite, carbon/graphite composite, urethane, a synthetic material, a polymer, or similar material. The flexible central portion can be configured and can function like the embodiments described above to move the cable guard end, cable guides and/or cables toward and away from the bowstring plane.

The central portion 512 can be joined with the riser end 511 and the cable end 513 by insertion of the bosses 515 and 516 into the corresponding bores 514 and 517. In this configuration, the components can be secured with a glue, cement or an adhesive such as, but not limited to, an epoxy. Optionally, on the central portion 512, bores may be provided in lieu of the bosses 515 and 516. This assembly could utilize dowels, of suitable material and dimensional configuration, secured in the corresponding bores of the central portion 512 and riser and cable ends, 511 and 513, respectively.

Figure 16:
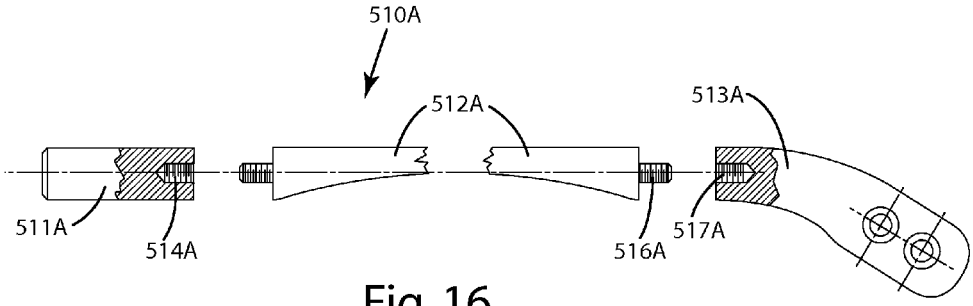
FIG. 16 is an exploded fragmented top view of an optional construction of the fifth alternative embodiment of the cable guard and guide.

FIG. 16 depicts a variation of this embodiment where the bosses 515A and 516A of the flexible center portion 512A are provided with external threads for threading into the corresponding internal threads of bores 514A and 517A of the riser and cable ends 511A and 513A, respectively. Of course, the bosses and bores of the ends and central portion can be reversed as desired in any combination.

As a further option, the riser end 511 and the central portion 512 can be manufactured as an integral, one piece monolithic structure with the cable end 513 connected to the monolith using any of the structures described above. In yet another option, the central portion 512 and the cable end 513 may be an integral, one piece, monolithic, structure with the riser end 511 connected to it.

The riser end, 511 or 511A, may be configured in a variety of ways, as previously described, to mount the guard to the riser of the bow. The cable end, or second end or guide end portion, 513 or 513A, may be provided with any of the cable guides that are described elsewhere herein.

On the embodiments shown in FIG. 15 and FIG. 16, as with any of the embodiments herein, if desired, radii or chamfers can be provided on the outer edges of bores and internal threads to avoid stress concentration on mating parts. Similarly, fillets at the inside juncture of a boss with its shoulder can also be provided.

Mounting of this embodiment to the riser may be accomplished by any of the structures described above. Similarly, the guide of this embodiment may include any of the structures described herein, and the operation of this embodiment can be similar to any of the embodiments herein.

VIII. Sixth Alternative Embodiment

Figure 17:
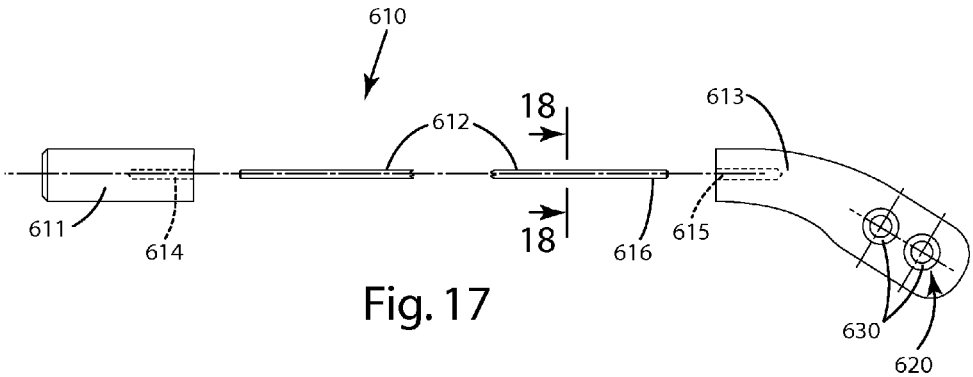
FIG. 17 is an exploded fragmented top view of a sixth alternative embodiment of the cable guard and guides.
Figure 18:
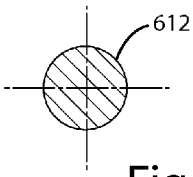
FIG. 18 is an enlarged cross-sectional view of the middle portion of the sixth alternative embodiment taken along line 18-18 in FIG. 17.

A sixth alternative embodiment of the cable guard is shown in FIGS. 17 and 18 and generally designated 610. This embodiment is similar to the above embodiments in structure and operation with a few exceptions. For example, the cable guard 610 includes rigid riser and cable ends, 611 and 613, respectively, and a flexible central portion 612 as shown in FIG. 17. The flexible central portion 612 can be an element constructed of metal, and can have a desired flexibility to provide the lateral displacement of the cable end, and any joined cable guide or cable, toward and away from the plane P in which the bowstring 103 moves as described in connection with any of the above embodiments.

The metal can be a high strength, high carbon and/or high tensile strength steel. For example, the element can be a piece of metal, such as a high tensile bar stock or wire having a minimum tensile strength optionally at least about 50,000 PSI (pounds per square inch), further optionally at least about 75,000 PSI, even further optionally at least about 100,000 PSI, yet further optionally at least about 200,000 PSI, and still further optionally at least about 300,000 PSI. The element and central portion in general can be a small diameter wire, optionally made of high carbon steel. The element or wire can have a maximum dimension, for example, a diameter of about 0.005 to about 0.5 inches, further optionally about 0.01 to about 0.25 inches, and even further optionally about 0.2 inches. Of course, elements of other diameters or dimensions can be used, depending on the desired degree of flexure and movement of the cable guide or cable end of the cable guard in general.

Where a wire is used, the wire can be a high tensile wire, such as high tensile music wire. As used herein, high tensile music wire means a high carbon spring steel element of any cross section having a minimum tensile strength of about 230,000-399,000 pounds per square inch. Particular music wire suitable for use with the cable guard herein can be constructed from a high carbon spring steel having the properties described in ASTM A228, of ASTM International, which is hereby incorporated by reference. In general, such music wire can have a nominal chemistry of 0.70%-1.00% Carbon and 0.20%-60% Manganese, a minimum tensile strength of about 230,000-399,000 PSI, a 45% design stress minimum tensile, about 11,500,000 G-modulus in torsion, about a 250 degree F. Maximum operating temperature, a C41-C60 Rockwell hardness, and/or a density of about 0.284 pounds per cubic inch.

If used in wire form, the wire can have a gauge optionally about 9/0 to about 80, further optionally about 4/0 to about 30, even further optionally about 2/0 to about 20, still further optionally about 0 to about 11, or any other gauges suitable to provide the desired degree of flexure in the guard.

While FIG. 18 depicts the cross-section of the element of the central portion 612 as cylindrical and wire-like, any uniform cross-section may be utilized. For example, the cross-section can be generally flat and rectangular, and the central portion can be in the form of a flat spring, a beam spring, or a leaf spring constructed from a variety of materials.

The riser and cable ends, 611 and 613 can be machined from metal such as, but not limited to, aluminum and/or titanium. Joining of a music wire central portion 612 to the metal end portions 611 and 613, in the areas 614 and 615 respectively, can be achieved using cements, glues, epoxies, brazing, press fitting, shrink fitting, and the like. Optionally, the central portion 612 can be integrally formed with one or both of the end portions 611 and 613. For example, the end portion 611 can be integrally formed with the central portion 612 in a drawings and subsequent machining operation, or the end portion and the central portion can be molded as a single monolithic unit in a molding operation.

Figure 19:
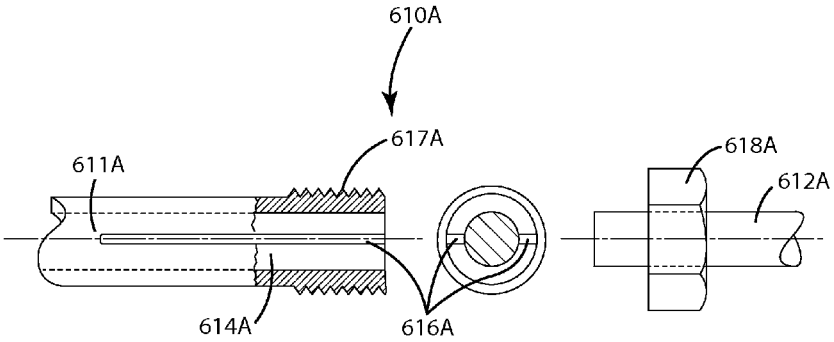
FIG. 19 is partial view of an optional construction of the sixth alternative embodiment.

Other configurations for joining the different components so they are integral can be implemented depending on the application. As another example, shown in FIG. 19, either one or both ends 611 and 613 may be joined to the central portion 612 by means of a collet arrangement. The collet arrangement can be applied to a modification of the riser end 611A. The collet effect is achieved as nut 618A advances on the slightly tapered external thread 617A on the first end portion 611A. The riser end 611A collapses inwardly on the bore 614A, in a controlled manner, by virtue of the two diametrically opposed slots 616A, thereby securing central portion 612A in bore 614A. While two slots are shown, three, four or more slots spaced uniformly or in a desired configuration may also be used.

Optionally, rigid composite materials, for example carbon/graphite, urethane, may be used to construct the ends 611 and 613. In this configuration, joining the central portion 612 to the ends 611 and 613 may be accomplished with, but not limited to, a glue, cement and/or an adhesive, such as an epoxy. Where the material of choice for the end portions 611 and 613 is moldable, insert molding of the middle portion 612 to the ends 611 and 613 may provide another method of attachment.

Mounting of this embodiment to the riser may be accomplished by any of the structures described above. Similarly, the guide of this embodiment may include any of the structures described herein, and the operation of this embodiment can be similar to any of the embodiments herein.

IX. Seventh Alternative Embodiment

Figure 20:
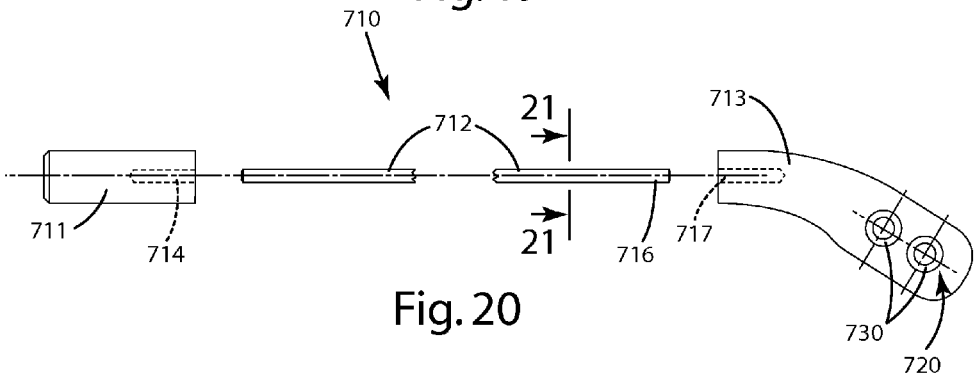
FIG. 20 is an exploded fragmented top view of a seventh alternative embodiment of the cable guard and guides.
Figure 21:
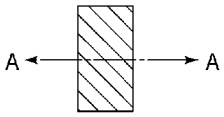
FIG. 21 is an enlarged cross-sectional view of the middle portion of the seventh alternative embodiment along line 20-20 in FIG. 19.

A seventh alternative embodiment of the cable guard is shown in FIGS. 20-21 and generally designated 710. This embodiment is similar to the above embodiment in structure and operation with a few exceptions. For example, the flexible central portion 712 is constructed from spring steel strip stock. This steel strip stock can be the metals described in connection with the above embodiment. While FIG. 21 depicts the cross-section as rectangular, any cross-section can be utilized that provides the desired flexure toward the bowstring plane.

The riser and cable ends, 711 and 713, can be machined from metal such as, but not limited to, aluminum and titanium. Joining of a spring steel strip central portion 712 to the metal ends 711 and 713, in the areas 714 and 715 respectively, can be achieved in a variety of ways such as via brazing, welding, fasteners, press fitting, shrink fitting, cementing and the like.

Optionally, relatively rigid composite materials, e.g. carbon/graphite, urethane, may be used for the ends 711 and 713. In this configuration, joining the spring steel strip central portion 712 to the end portions 711 and 713 may be accomplished with, but not limited to, glue, cement or an adhesive, such as an epoxy. Where the material used to construct the ends 711 and 713 is moldable, insert molding of the central portion 712 to the ends 711 and 713 can provide another method of attachment. Optionally, if the composite material for the ends 711 and 713 is sufficiently flexible, it could be molded in a form to encapsulate the flexible metal portion in its entirety.

Mounting of this embodiment to the riser may be accomplished by any of the structures described above. Similarly, the guide of this embodiment may include any of the structures described herein, and the operation of this embodiment can be similar to any of the embodiments herein.

X. Eighth Alternative Embodiment

Figure 22:
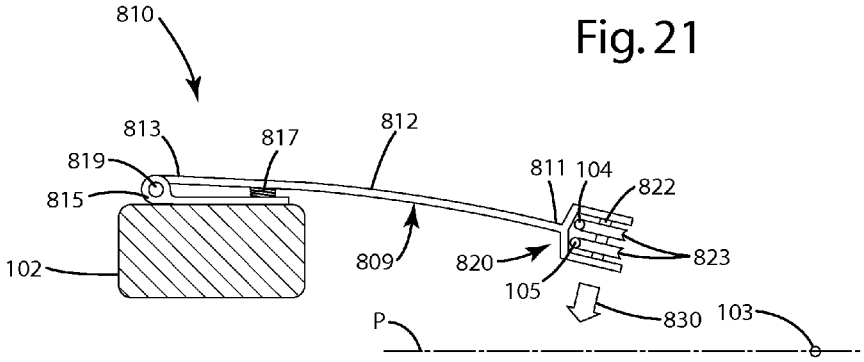
FIG. 22 is a top view of an eighth alternative embodiment of the cable guard and guides.

An eighth alternative embodiment of the cable guard is shown in FIG. 22 and generally designated 810. This embodiment is similar to the above embodiments with several exceptions. For example, the cable guide 820 is generally in the form of a movable element, such as a rotatable pulley system, including pulleys 823 that accommodate the respective cables 104 and 105. The pulleys rotate about the axle 822. The precise pulley configuration can be any of those conventional pulley guide system, for example, that illustrated in U.S. Pat. No. 6,722,354 to Land, which is hereby incorporated by reference in its entirety.

The cable guide 820 can move toward the plane P in which bowstring moves 103 as shown by the arrow 830 to provide the desired amount of flexing of the cable guard 810, which in turn, as discussed above, can reduce cable lean, prevent premature cable wear and/or reduce limb twist. In this embodiment, however, the cable guide 820 is connected via a bar 809 including a riser and 813 a central portion 812 and a cable end 811. The bar 809 can be a relatively rigid and inflexible. The flexibility of the unit can be provided via the pivoting action of the bar about the pivot 819. A bias member 817 can be mounted between a mounting plate 815 and the cable guard bar 809. The bias member 817 can be a coil spring or any other suitable spring or elastomeric element that urges the cable guard bar 809 away from the mounting plate 815 or bowstring plane P a predetermined amount. The mounting plate 815 can be mounted directly to the riser 102. The bias member 817 can be selected to provide the desired amount of movement toward the bowstring plane P in which the bowstring 103 moves. Optionally, the cable guard 810 can be sold with a set of different bias members having different compression characteristics to fine tune the operation of the cable guard 810 so that it moves in a desired way toward and away from the bowstring plane P.

If desired, the cable guard bar 809 can be configured to flex to a slight degree to compliment the bias member 817. As an example, the bar 809 can be constructed to have the configurations or constructed from the materials of any of the embodiments above to provide desired flexing or bending. Further, the bias member 817 can be mounted directly between the cable bar 809 and the riser 102 if desired, in which case the plate 815 can be absent. Additionally, the pivot hinge 819 can be replaced with any other suitable hinge-type element that enables the bar 809 to flex as desired. Further optionally, the illustrated movable guide including a rotatable pulley system can be replaced with any of the other guide elements described above.

Mounting of this embodiment to the riser may be accomplished by any of the structures described above. Similarly, the guide of this embodiment may include any of the structures described herein, and the operation of this embodiment can be similar to any of the embodiments herein.

XI. Ninth Alternative Embodiment

Figure 23:
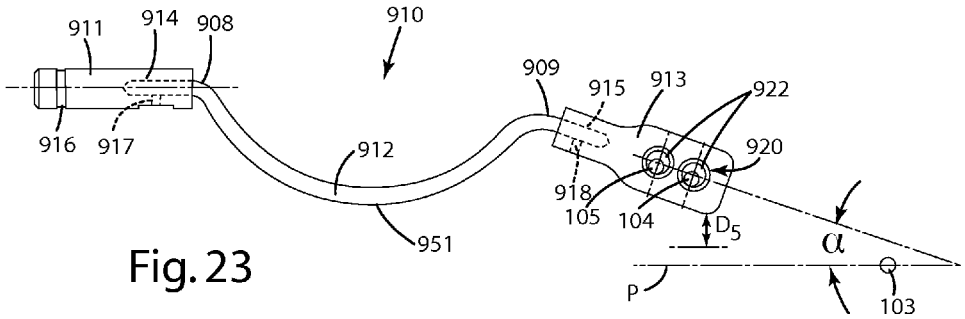
FIG. 23 is a top view of a ninth alternative embodiment of the cable guard and guides.
Figure 24:
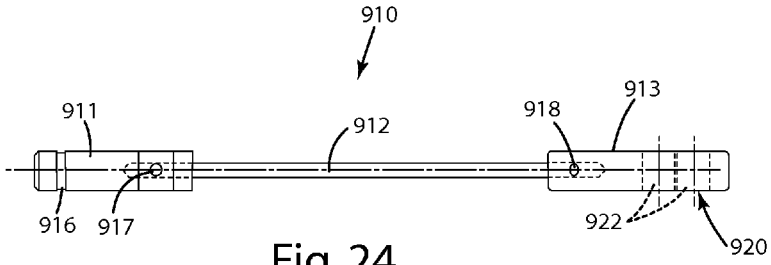
FIG. 24 is a side view of the ninth alternative embodiment of the cable guard and guides.

A ninth alternative embodiment of the cable guard is illustrated in FIGS. 23 and 24 and generally designated 910. This embodiment is similar to the above embodiments with several exceptions. For example, the cable guard 910 can include a front portion 911 that is adapted to mount to the riser 102 of the bow 100, a central portion 912 that is adapted to flex, and a rear portion 913, which can include or can be joined with a cable guard 913 defining the cable guard bores 922 to form a cable guide 920.

As shown, the riser end 911 can be a cylindrical or other geometrically shaped element with an optional annular recess 916 provided to accept a set screw to secure the cable guard 910 to the riser 102 of the bow 100 (not shown). The front end 911 also can define a bore 914 adapted to accept the front end 908 of the central portion 912 of the cable guard 910. Other configurations for the riser end 911 as described in embodiments herein can be substituted in this embodiment.

The front and rear portions 911 and 913 can be machined from metal, for example, aluminum, magnesium or titanium, or formed from a suitable composite material.

The central portion 912 of the cable guard 910 can be flexible. To achieve its flexibility, the central portion optionally can be constructed from the materials, such as the high tensile music wire or other materials of the seventh embodiment herein. The wire can be of the proper gauge to achieve the desired degree of flexure. Further optionally, the high tensile music wire can be of a uniform, non-varying cross-section if desired. For example, the cross-section can be cylindrical, hexagonal, or generally flat and rectangular and in the form of a flat spring.

As shown in FIG. 23, the central portion 912 can be formed in a curvilinear and/or circular segment which lies in a plane generally perpendicular to the plane P in which the bowstring 103 travels. The apex 951 of this circular segment can be oriented toward the plane P of the travel of the bowstring 103, or away from the bowstring plane P. Optionally, the central portion 912 can be configured as shown to include a convex curve with an apex 951 facing toward the bowstring plane P. If desired, although not shown, the central portion could be configured to include a concave curve with an apex facing away from the bowstring plane P.

The rear portion 913 of the cable guard 910 can include or can be joined with a cable guide 920. As noted above, the cable guard end 913 can define the cable guide bores 922. The cable guard end 913, and generally the cable guide 920 formed therefrom, as well as the bores 922 can be oriented at an angle $\alpha$ and perpendicular to the plane P of the bowstring 103 travel. The angle $\alpha$ can be the same as the angle $\alpha$ described in any of the other embodiments herein. For example, the angle $\alpha$ can be about 0 to about 90 degrees, further optionally about 20 to about 50 degrees, and even further optionally about 30 degrees. With this offset angle $\alpha$, the guide element 920 can locate the cables 104, 105 a suitable distance from the plane P in which the bowstring 103 travels. The angle $\alpha$ can be selected to enable the cable guard 910 to flex and precisely move and position the cables relative to the bowstring travel plane P, and accordingly, to provide clearance for vanes of an arrow shot from the bow 100 after the bowstring is released.

The cable guard end 913 optionally can define a bore 915 configured to accept the rear end 909 of the central portion 912 of the cable guard 910. Of course, other configurations for the cable guard end 913 or cable end of the cable guard as described in other embodiments herein can be substituted with that of this embodiment if desired.

The ends 908 and 909 of the central portion 912 can be fixedly secured to the respective end portions 911 and 913 with set screws 917 and 918. If desired, the set screws can be substituted with other elements or joining processes, for example, cements, glues, epoxies, brazing, press fitting, shrink fitting, and the like.

Operation of the embodiment shown in FIGS. 23 and 24 is similar to that of the other embodiments described herein. In general, the cable guide 920 guides the cables 104 and 105. Further, with the configuration, shape, cross section and/or material of the central portion 912, the guide 920 can flex distance $D_5$ toward or away from the plane P in which the bowstring 103 moves.

Mounting of this embodiment to the riser may be accomplished by any of the structures described above. Similarly, the guide of this embodiment may include any of the structures described herein, and the operation of this embodiment can be similar to any of the embodiments herein.

XII. Tenth Alternative Embodiment

Figure 25:
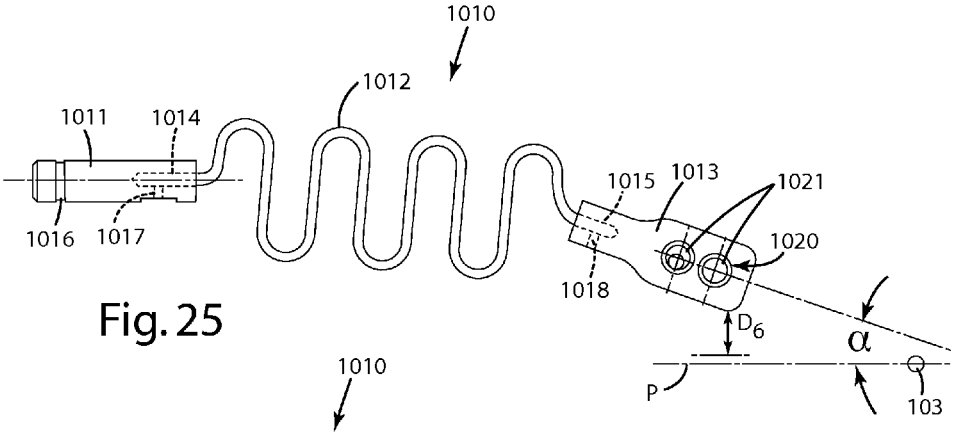
FIG. 25 is a top view of a tenth alternative embodiment of the cable guard and guides.
Figure 26:
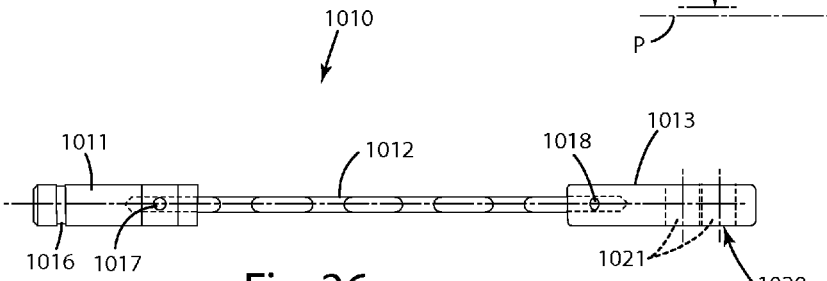
FIG. 26 is a side view of the tenth alternative embodiment of the cable guard and guides.

A tenth alternative embodiment of the cable guard is shown in FIGS. 25 and 26 and generally designated 1010. This embodiment is similar to the ninth alternative embodiment with several exceptions. For example, the central portion 1012 of the cable guard 1010 can differ in shape from the ninth alternative embodiment of the cable guard 910. As illustrated in FIG. 25, the central portion 1012 can be formed with at least one of a series of reverse loops, or convex and concave curves, lying in a plane generally perpendicular to the plane P of the travel of the bowstring 103. The loops can be aligned with the rear portion including the cable guide 1012 so that the cable guide bores generally lay at an angle $\alpha$ with the plane P. This angle $\alpha$ can be the same as that described in the embodiments above. Further, the central portion 1012 can be joined with the riser end 1011 and the cable end 1013.

Operation of the cable guard and guide in this embodiment can be similar to that of the other embodiments herein. For example, the guard 1010 can flex toward and away from the plane P in which the bowstring 103 moves some preselected distance $D_6$.

Mounting of this embodiment to the riser may be accomplished by any of the structures described above. Similarly, the guide of this embodiment may include any of the structures described herein, and the operation of this embodiment can be similar to any of the embodiments herein.

XIII. Eleventh Alternative Embodiment

Figure 27:
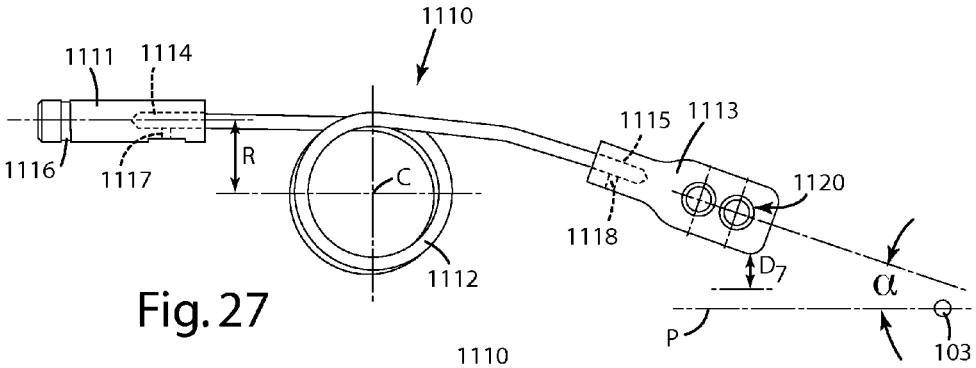
FIG. 27 is a top view of an eleventh alternative embodiment of the cable guard and guides.
Figure 28:
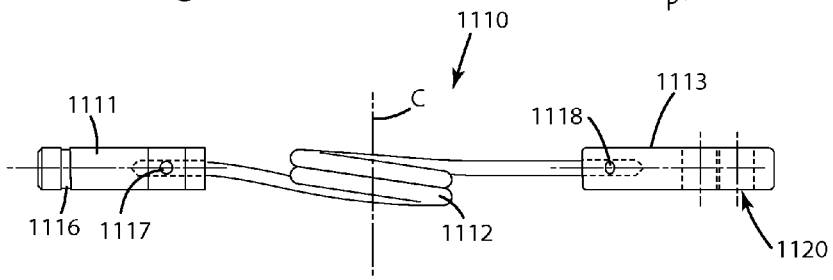
FIG. 28 is a side view of the eleventh alternative embodiment of the cable guard and guides.

An eleventh alternative embodiment of the cable guard is shown in FIGS. 27 and 28 and generally designated 1110. This embodiment is similar to the cable guard of the two above embodiments 910 and 1010, with several exceptions. For example, the central portion 1112 of the cable guard 1110 can include coils that are concentric about a vertical axis C. The vertical axis C can be displaced a distance R from the centerline of the bore 1114 of the riser portion 1111 in a direction toward the plane P in which the bowstring 103 travels, or alternatively away from the bowstring plane P. As can be seen in FIG. 27, the distance R can be the radius of the coils formed in the central portion 1112 of the cable guard 1110. The size of the radius R can be determined by the desired arrow vane clearance as the arrow moves in plane P as it is being shot from the bow.

Operation of the cable guard and guide in this embodiment can be similar to that of the other embodiments herein. For example, the guard 1110 can flex toward and away from the plane P in which the bowstring 103 moves some preselected distance $D_7$.

Mounting of this embodiment to the riser may be accomplished by any of the structures described above. Similarly, the guide of this embodiment may include any of the structures described herein, and the operation of this embodiment can be similar to any of the embodiments herein.

XIV. Twelfth Alternative Embodiment

Figure 29:
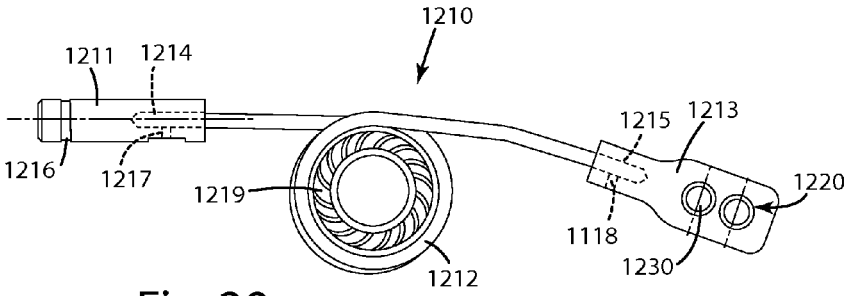
FIG. 29 is a top view of a twelfth alternative embodiment of the cable guard and guides.
Figure 30:
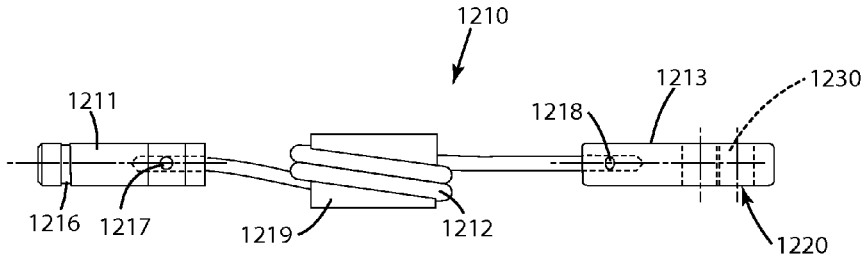
FIG. 30 is a side view of the twelfth alternative embodiment of the cable guard and guides.

A twelfth alternative embodiment of the cable guard is shown in FIGS. 29 and 30 and generally designated 1210. This embodiment is similar to the embodiment of FIGS. 27 and 28 with several exceptions. For example, a vibration and noise suppression element 1219 can be positioned and held with the coils of the central portion 1212. The vibration and noise suppression element 1219 can be molded from a resilient material such as a rubber compound with suitable dampening characteristics. One type of element suitable for this embodiment is a "harmonic damper" which is commercially available from Mathews, Inc., of Sparta, Wis. This vibration and noise suppression element 1219 can include an outer molded resilient member of an annular shape, and a hollow cylindrical center portion structured to retain an optional rigid center portion. The outer surface of the resilient member 1219 can be sized to provide a compression fit within the inner diameter of the coils of the central portion 1212. Optionally, at least one outer circumferential lip can be provided on the resilient member to further enhance retention. The vibration and noise suppression element 1219 can take on other forms if desired.

Mounting of this embodiment to the riser may be accomplished by any of the structures described above. Similarly, the guide of this embodiment may include any of the structures described herein, and the operation of this embodiment can be similar to any of the embodiments herein.

XV. Thirteenth Alternative Embodiment

A thirteenth alternative embodiment of the cable guard is shown in FIGS. 31-35 and generally designated 1310. This embodiment is similar to the above embodiments with a few exceptions. For example, the cable guard 1310 can include a relatively rigid central portion 1316 so that the cable end 1313 and hence the cable guide bore 1322, are held in a generally fixed position relative to the riser 102. Accordingly, one or both of these features can be modified to provide lateral movement of the cables 104, 105, which, in turn, can impair or prevent excessive wear or stress on the cables. Optionally, although this and some subsequent embodiments are described as including a relatively rigid central portion, that central portion, or other components of the cable guard can be configure to flex as with the above embodiments to provide flexing or bending and subsequent movement toward and away from the bowstring plane P. Further optionally, these features can constrain movement of the cables so they do not interfere with movement of the bowstring.

As shown in FIGS. 31-38, the cable guard 1310 can include an upper surface 1352 and a lower surface 1354. The cable guard end 1313 can define an elongated bore 1322 extending transversely through the cable guard from the upper surface 1352 to the lower surface 1354. This elongated bore 1322 can include a first end 1361 and a second end 1362 opposite the first end. The elongated bore 1322 can also be bounded by an inner surface or an inner wall 1364 extending from the first end 1361 to the second end 1362. The elongated bore including a first axis or minor axis 1355 that is generally parallel to the bowstring 103 when the bowstring is in an undrawn state. This minor axis 1355 can extend from the upper surface 1352 to the lower surface 1354, similar to the axes of the bores described in connection with the embodiments above.

The elongated bore 1322, however, also can include a second axis or major axis 1365 that is transverse, and generally perpendicular to the to the minor axis 1355. This major 1355 axis can extend from the first end 1361 toward the second end 1362 of the elongated bore 1322.

Figure 32:
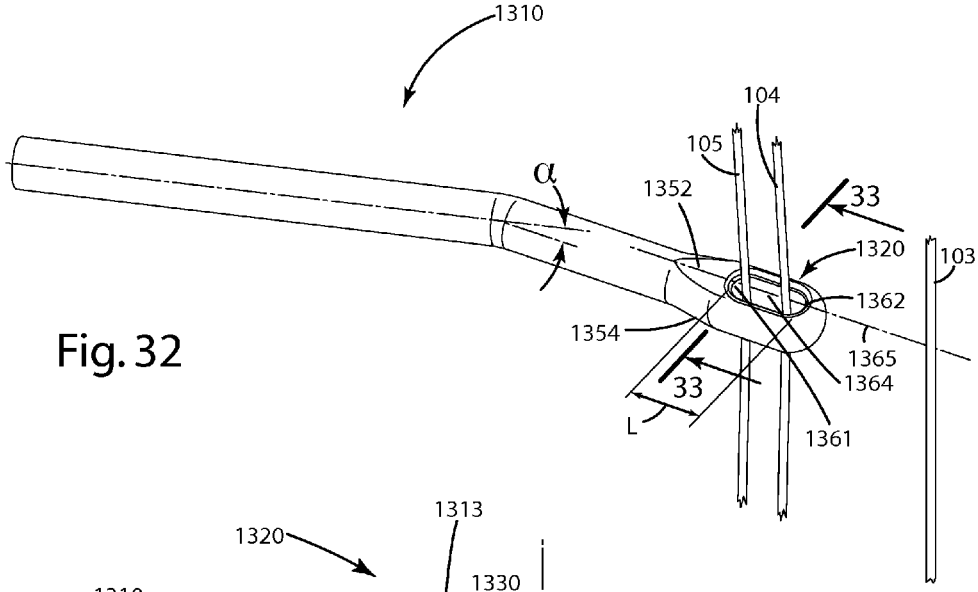
FIG. 32 is a perspective view of the thirteenth alternative embodiment of a cable guard and guide illustrating associated cables and a bow string.
Figure 33:
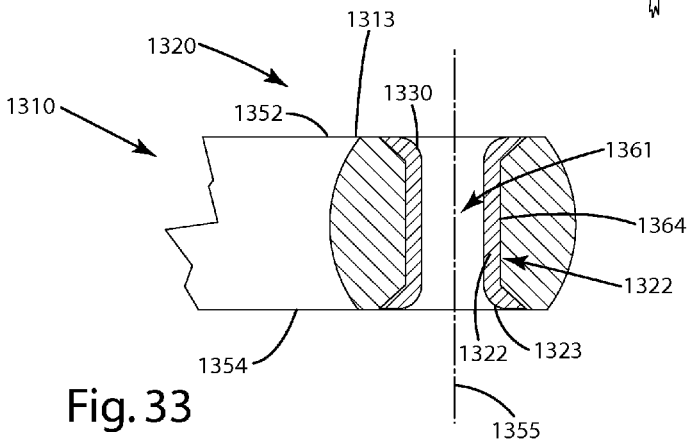
FIG. 33 is a partial cross-sectional view of the thirteenth alternative embodiment of the cable guard and guide taken along line 33-33 of FIG. 32 illustrating the cable guide insert.

Referring to FIGS. 32 and 33, the length L along the major axis 1365 of the elongated bore 1322 can be sufficient to allow for the desired lateral movement of the cables 104 and 105, forward and/or away from the bowstring, as the bowstring 103 is drawn or otherwise moves. The elongated bore 1322 can be of a length L, optionally about ½", ¾", 1", 1½", or 2" or more inches.

Generally, in operation, the cables 104, 105 extend through the elongated bore 1322 so that, when the bowstring 103 moves, the cables 104 and 105 slide relative to the elongated bore 1322 in a first direction generally parallel to the minor axis 1355. In so sliding, the cables can directly engage the inner wall 1364 and/or ends 1361, 1362 of the bore. Optionally, however, where an insert 1330 is included in the bore, while sliding relative to the bore 1322, the cables 104, 105 can instead directly engage the respective surfaces of the insert 1330. To clarify, where an object slides relative to another object as used herein does not always result in the objects directly engaging surfaces of one another.

Returning to the motion of the cables 104 and 105, as the bowstring 103 moves, the cables 104, 105 can also substantially simultaneously as the relative sliding above, slide relative to the inner wall 1364 in a second direction leading from the first end 1361 toward the second end 1362 of the elongated bore, or vice versa.

The elongated bore 1322 can be configured so that the major axis 1365 is lays within a plane, where that plane is parallel to or at some angle relative to the bowstring plane P in which the bowstring 103 moves.

With reference to FIG. 33, the cable guard bore 1322 of the cable end 1313 can be sized to accommodate a single cable guide insert 1330, which can define a single cable bore 1321 within which, one or both of the cables 107, 108 can move, for example, within which both can slide parallel to the respective major and minor axes 1355 and/or 1366. Generally, the cable end 1313 defining the cable bore 1322 can form the cable guide 1320 of this embodiment. Optionally, with the insert included in this embodiment, the cable end 1313, bore 1322 and insert 1330 can cooperatively form the cable guide 1320.

Figure 34:
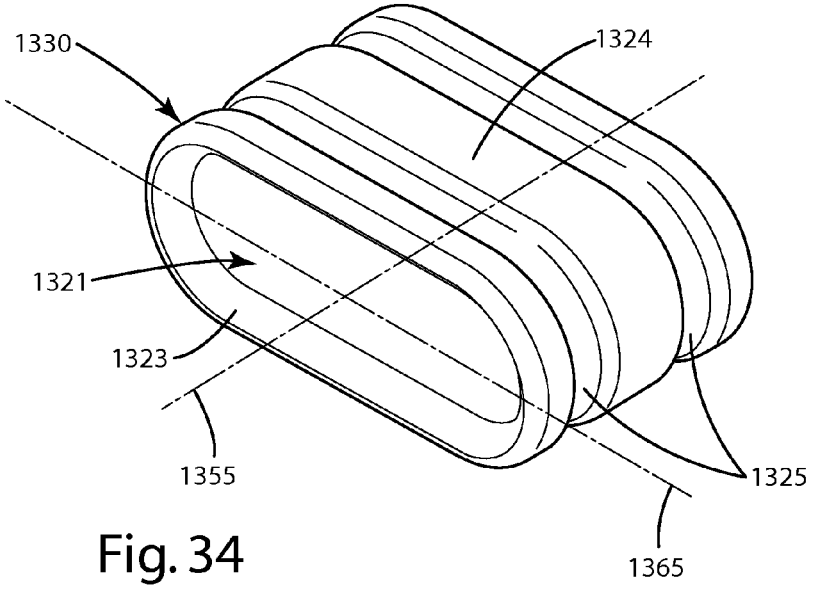
FIG. 34 is a perspective view of the thirteenth alternative embodiment of the cable guide insert.
Figure 35:
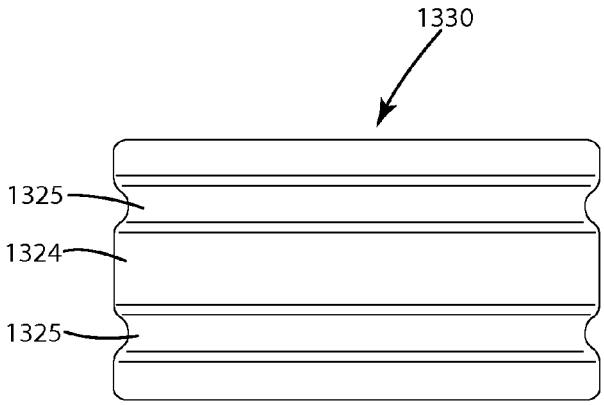
FIG. 35 is a side view of the thirteenth alternative embodiment of the cable guide insert.
Figure 36:
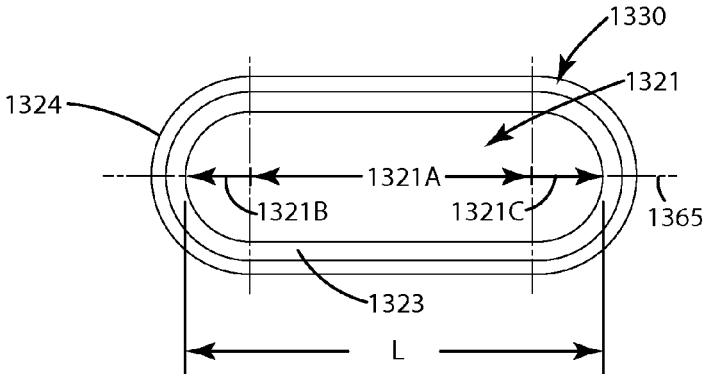
FIG. 36 is a top view of the thirteenth alternative embodiment of the cable guide insert.

As shown in FIGS. 33-35, the cable guide bore 1321 can be of a length L, and can include rectilinear center portion 1321*a*, which transitions to generally semi-circular portions 1321*b* and 1321*c*. These semicircular portions can correspond to the respective ends 1361 and 1362 of the bore 1322 when the insert 1330 is installed in the bore 1322. As with embodiments described above, the edges 1323 near the ingress and egress portions of the cable guide bore 1321 can be radiused or chamfered to reduce friction and wear on the cables 104, 105. Optionally, the outer surface 1324 of the insert 1330 can be provided with one or more circumferential grooves or depressions 1325 for retaining adhesive or "O" rings. The adhesive or "O" rings may be utilized for retention of the insert 1330 in the cable guard 1310 as described below.

The cable guide insert 1330 can be constructed from any of the low friction materials described in connection with the embodiments above.

Figure 31:
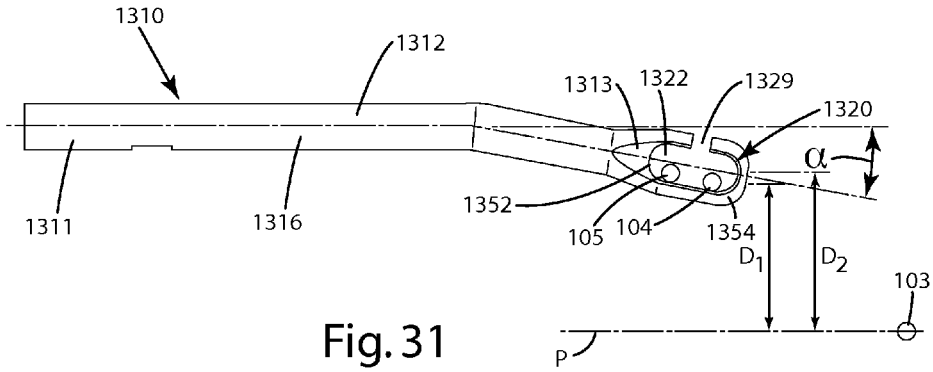
FIG. 31 is a top view of a thirteenth alternative embodiment of the cable guard and guide illustrating the relative positioning of the bowstring and cables in relation to the plane of the bowstring travel.

As shown in FIG. 31, the cable guide 1320, cable insert 1330 and cable guard end 1313 optionally can define a slot 1329. This slot 1329 can be located on the side of the guide 1320 opposite the plane P of the bowstring 103. With this construction, the cables 104, 105 can be inserted and removed somewhat easily from the cable guide bore 1321 and/or cable guard bore 1322, simply by lifting the cables 104, 105 in or out through the slot 1329. As desired, this slot can be included in any other embodiment described herein, or eliminated altogether.

XVI. Fourteenth Alternative Embodiment

Figure 37:
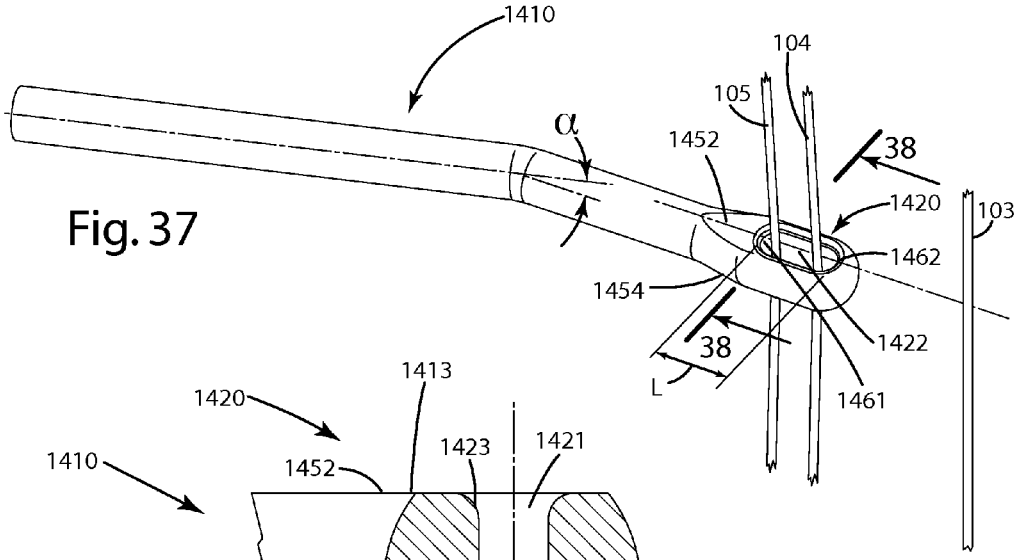
FIG. 37 is a perspective view of the fourteenth alternative embodiment of the cable guard and guide.
Figure 38:
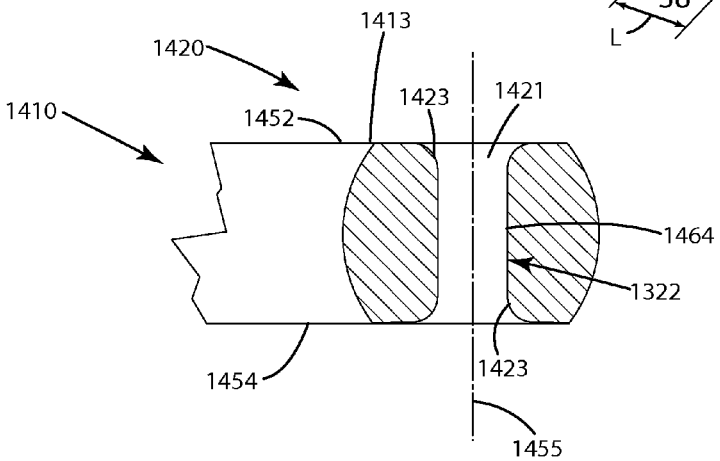
FIG. 38 is a partial cross-sectional view of the fourteenth alternative embodiment of the cable guard and guide taken along line 38-38 of FIG. 37 illustrating a cable guide bore.

A fourteenth alternative embodiment of the cable guard is shown in FIGS. 37-38 and generally designated 1410. This embodiment is similar to the other embodiments described herein with several exceptions. For example, the cable guide portion 1413 of the cable guard 1410 does not include a cable guide insert. Rather, the cable end 1413 of the cable guard 1410 simply defines the cable guide bore 1422. The end and the bore generally form the cable guide 1420.

The surface of the bore 1422 can be of the same material as the guard end 1413. Optionally, the surface of the bore 1422 can be of sufficient hardness to withstand abrasion from the movement the cables 104 and 105, and can be smooth enough and contoured to minimize friction and prevent or impair undue wear on the cables, as described in connection with the bores of other embodiments above.

XVII. Fifteenth Alternative Embodiment

Figure 39:
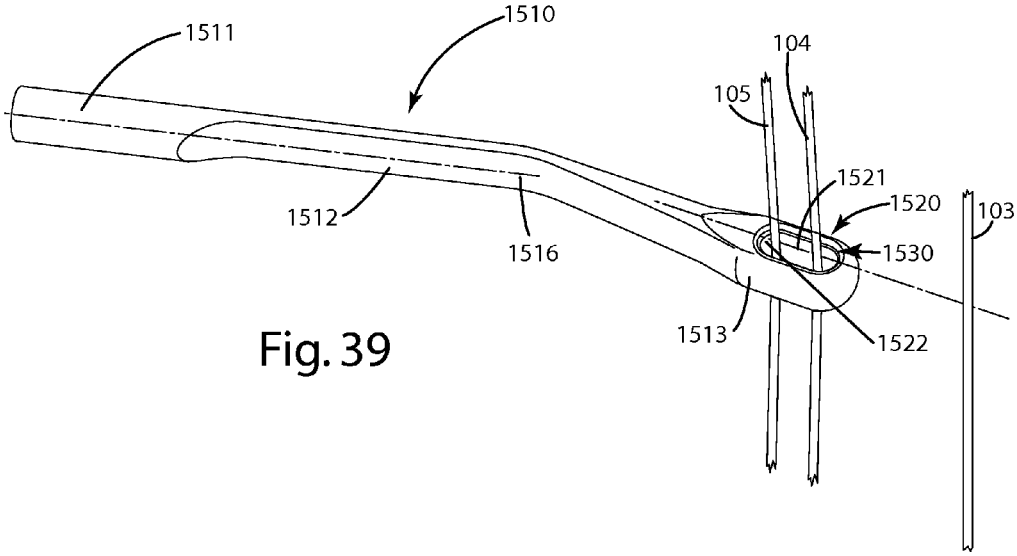
FIG. 39 is a perspective view of a fifteenth alternative embodiment of the cable guard and guide.

A fifteenth alternative embodiment of the cable guard and guide is shown in FIG. 39, and generally designated 1510. This embodiment is similar to the embodiments above with several exceptions. For example, the cable guard 1510 includes a flexible center portion 1516 that is adapted to flex to enable the cable guide 1520 to move relative a bowstring plane as with earlier embodiments. For example, the central portion 1516 can include a reduced cross-section that provides the flexibility. Of course, other structures described herein can provide the desired flexibility as well. The cable guide 1520 of this embodiment, optionally can include an insert 1530 included in cable bore 1522, which defines a single guide bore 1521 within which both cables 104, 105 are captured or otherwise move. Alternatively, the insert 1330 can be absent, the single cable bore 1322 can be defined in the cable end 1513 of the cable guard 1510, and the cables 104, 105 can move in it as with the embodiments described above.

XVIII. Sixteenth Alternative Embodiment

Figure 40:
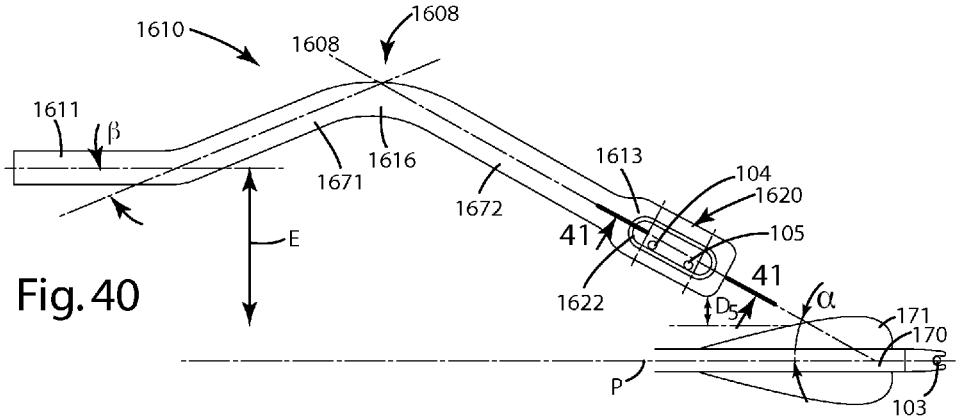
FIG. 40 is a top view of a sixteenth alternative embodiment of the cable guard and guide.
Figure 41:
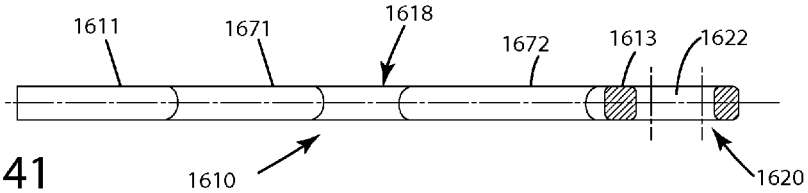
FIG. 41 is a cross sectional view of the sixteenth alternative embodiment of the cable guard and guide taken along line 41-41 of FIG. 40.

A sixteenth alternative embodiment of the cable guard is shown in FIGS. 40 and 41, and generally designated 1610. This embodiment is similar to the other embodiments herein, with several exceptions. For example, the guard 1610 can be a rigid rod including two opposing curves, generally lying in a plane perpendicular to plane P of the bowstring 103 travel, such that the centerline of the guide 1620 achieves the prescribed angle $\alpha$ to the bowstring plane P. The angle $\alpha$ may be between about 10 and about 50 degrees, optionally between about 20 and about 40 degrees, and further optionally between about 25 and about 35 degrees. The angle $\beta$ between the first and second portions, 1611 and 1671 respectively, of the guard 1610 can be determined generally by the angle $\alpha$ and the distance E between the plane P of the bowstring 103 and the centerline of the first portion 1611 as it is mounted to a riser of a bow.

The cable guide 1620 can define a single elongated bore 1622 within which both cables 104 and 105 can be captured and/or can move. The bore 1622 can be defined by the cable guard end 1613, and optionally can include a cable guide insert (not shown).

The cable guard 1610 can include a cylindrical or other cross-section as described herein, and can be constructed from any material described herein that can be formed into the desired shape.

The configuration, shape, cross section and/or material of the cable guard 1610 can be selected to enable the guard end 1613, guide 1620 and/or cables to laterally move toward and away from the bowstring plane P a distance $D_3$ as the bowstring moves. As with the other embodiments including flexible cable guard herein, when the bowstring 103 is drawn, the cables 104, 105 come under additional tension and force the guide 1620 toward the bowstring plane P. As this occurs, the guard 1610 flexes or bends under the force. The cable guide 1620, guard end 1613, and cables move the distance $D_4$ which can place these components, or at least a portion thereof, in the path of the arrow fletchings 171 of the arrow 170 moved by the bowstring 103. Due to the configuration, shape, cross section and/or material of the cable guard 1610, when the bowstring 103 moves after being released from full draw, the cable guide 1620, guard end 1613, and cables move the preselected distance $D_3$ away from the bowstring plane P. This movement over the distance $D_3$ removes the components from the path of the arrow fletchings 171, as the arrow moves with the bowstring, and as the arrow moves past the cable guard and/or cable guide. Accordingly, the cable guide, guard and/or cables do not interfere with the flight of the arrow.

Generally, the cable guard and guide are constructed so that when the bowstring is drawn in the bowstring plane P, forces are transferred from the bowstring 103 to the cables 104 and 105. These forces cause the cable guide 1620 to move a distance $D_3$ toward the bowstring plane. The fletchings of the arrow 171, however are unaffected by this movement, because those fletchings are near the bowstring which is drawn a distance away from the cable guard and guide.

XIX. Seventeenth Alternative Embodiment

Figure 42:
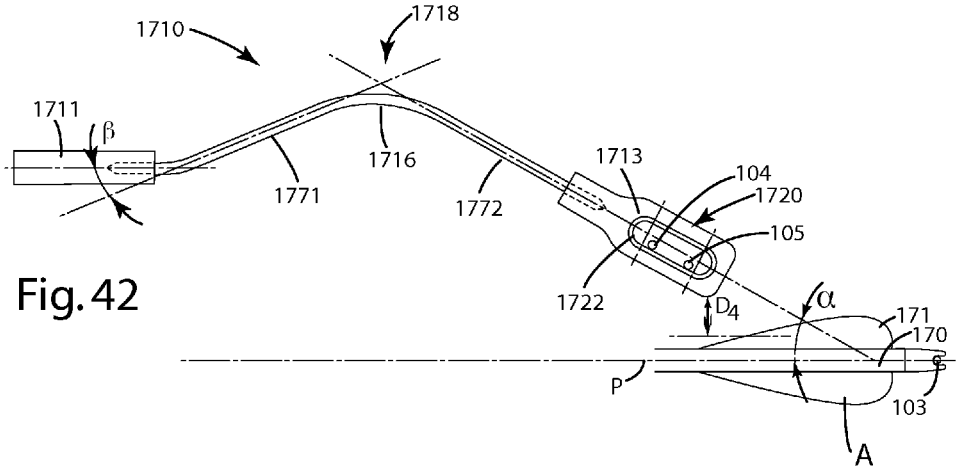
FIG. 42 is a top view of a seventeenth alternative embodiment of the cable guard and guide.
Figure 43:
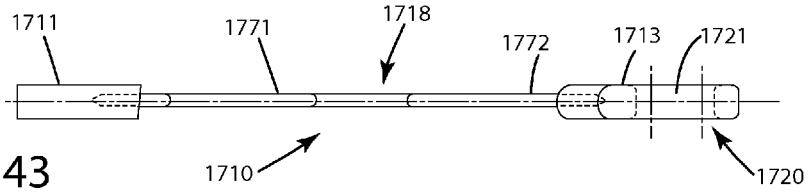
FIG. 43 is a side view of the seventeenth alternative embodiment of the cable guard and guide.

A seventeenth alternative embodiment of the cable guard is illustrated in FIGS. 42 and 43 and generally designated 1710. This embodiment is similar to the other embodiments herein with several exceptions. For example, the central portion 1716 can include a first portion 1771 joined with a riser end 1711 which is further joined with a riser of the bow. The first portion 1771 can be joined with a second portion 1772 at a transition area or portion 1718. The first portion 1771 and second portion 1772 can be offset relative to one another at the transition portion 1718 at an angle at optionally about 2 to about 70 degrees, further optionally about 10 to about 60 degrees, and even further optionally about 40 degrees. The transition portion 1718 can form a gradual curve or can form an abrupt angle.

The second portion 1772 of the central portion 1716 can be further joined with the cable guard end 1713. These pieces can be joined with fasteners, epoxy, glue, adhesives, threading, a press fit, a shrink fit, or any other suitable joining structure as described herein. Further, the central portion 1716 can be formed into the desired shape and construction from high tensile wire, for example music wire, and optionally constructed from titanium or some other suitable material as described in connection with the embodiments herein.

Like the embodiments above, the configuration, shape, cross section and/or material of the cable guard can enable the end and guide to move toward and away from the bowstring plane P a distance $D_4$ when the bowstring moves. In turn, this can provide adequate fletching clearance for an arrow shot from the bow.

XX. Eighteenth Alternative Embodiment

Figure 44:
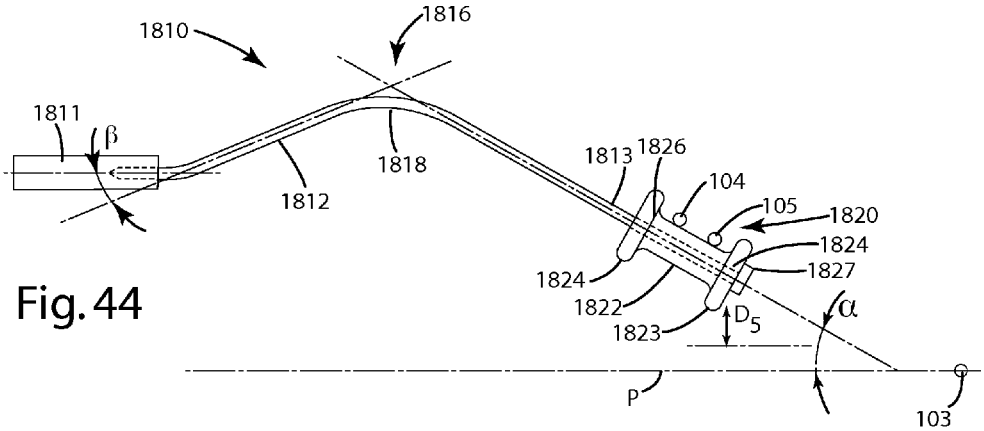
FIG. 44 is a top view an eighteenth alternative embodiment of the cable guard and guide.
Figure 45:
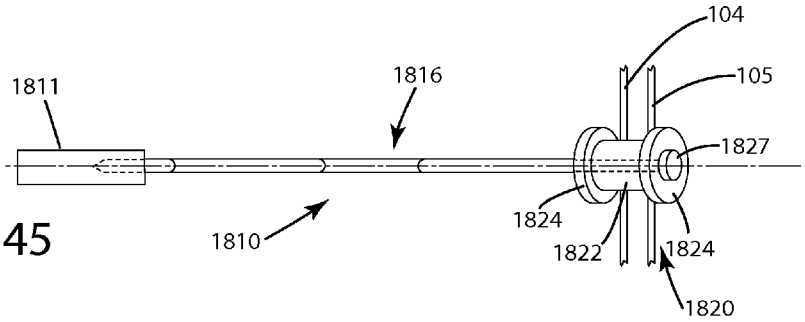
FIG. 45 is a side view of the eighteenth alternative embodiment of the cable guard and guide.

An eighteenth alternative embodiment of the cable guard illustrated in FIGS. 44 and 45 and generally designated 1810. This embodiment is similar to the other embodiments herein, for example, the immediately preceding embodiment, with several exceptions. In this embodiment, the cable guard end 1813 can include a cable guide 1820 in the form of a spool joined with the end 1813. The spool 1820 can be generally cylindrical, and can include first and second shoulders 1824 and a cable engagement surface 1822 therebetween. The cables 104, 105 can engage the cable engagement surface 1822 and can be guided between the first and second shoulders 1824. The spool can define a bore 1826 that is adapted to receive the end 1813 of the cable guard 1810.

The cable guide 1820 or spool of this embodiment can be fixedly joined with the end 1813 or optionally allowed to rotate about its axis. The cable guide 620 can further be restrained in a particular location by an optional retention element 1827. This retention element 1827 can be in a form of a nut, a pin, or other retaining component that is joined with the cable guard 1810.

The cable guide 1820 can be constructed from any material, for example ceramic, glazed ceramic, composite, polymer, metal, or virtually any other material. Further, the respective angles α and β can be the same as that in any of the above described embodiments. Operation of the cable guard and guide of this embodiment can be similar to that of the other embodiments herein.

XXI. Nineteenth Alternative Embodiment

Figure 46:
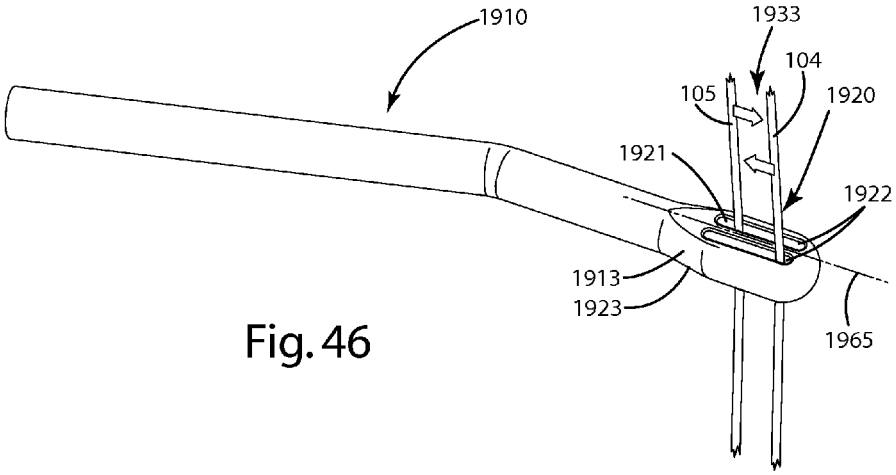
FIG. 46 is perspective view of a nineteenth alternative embodiment of the guard and guide.

A nineteenth alternative embodiment of the cable guard is illustrated in FIG. 46 and generally designated 1910. This embodiment is similar to the other embodiments herein with several exceptions. For example, the cable guide 1920 can define separate and distinct elongated bores 1921 and 1923. These elongated bores can be parallel, but of course, can be offset at some predetermined angle relative to one another. Each of the bores can individually constrain movement of each of the respective cables 104 and 105. The elongated bores 1921 and 1923 can optionally substantially circumferentiate the respective cables, yet still allow them to move along the major axis 1965 of the guide 1920 in the direction of the arrows 1933, moving and engaging the surfaces as described in connection with the embodiments above. Accordingly, when the bow is drawn, and the cables 104 and 105 have additional forces transferred to them from the bowstring or other components of the bow, the cables 104 and 105 can slide along or within the respective elongated bores or slots, generally along the axis 1965. This can reduce excessive wear on the respective cables.

The elongated bores 1921 and 1823 can be defined by an insert constructed from any of the material described herein, or can be defined directly in the cable guard end 1913 as with any of the embodiments described herein. Optionally, the cable guard 1910 can be configured with a reduced dimension, or can include any of the structure of the embodiments of the cable guard described above that will enable the cable guard end, cable guide and/or cables to selectively move a preselected distance toward and/or away from the bowstring plane.

XX. Twentieth Alternative Embodiment

A twentieth alternative embodiment of the cable guard is illustrated in FIGS. 47-50 and generally designated 2010. This embodiment is similar to the other embodiments herein with several exceptions. For example, the cable guard 2010 can include a riser end 2011 and a cable end 2013. The riser end 2011 can be joined with the riser 102 as described in any of the embodiments herein. The cable guard can generally be of a length sufficient to extend from the riser 102 to the cables 104 and 105, and effectively capture or otherwise guide the cables so that they are constrained to move within a desired region when the bow is drawn, and held within a desired region when the bow is undrawn.

The cable guard can generally include an upper surface 2052 and an opposing lower surface 2054. Both of these surfaces can be considered to be exterior surfaces of the cable guard. At or near the cable end 2013, the cable guard can define cable guard bore 2021 and/or a cable recess 2023. While both a bore and a recess are present in the embodiment shown in FIG. 47; both elements for the respective cables 104 and 105 can be bores, or both can be recesses.

Figure 48:
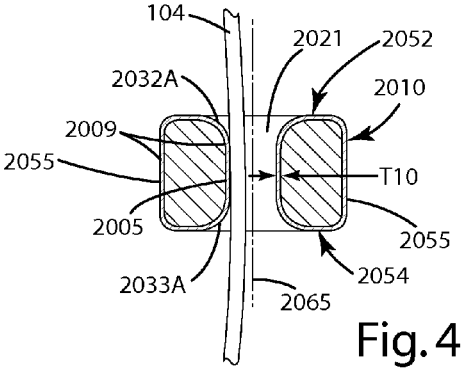
FIG. 48 is a cross sectional view of the twentieth alternative embodiment of the cable guard taken along line 48, 50-48, 50 of FIG. 47.

As shown in FIG. 48, the cable guard bore 2021 generally extends through the cable guard and is void of any moving parts therein or associated therewith. The bore 2021 can include a cable facing surface 2005 which can be a surface or a wall, optionally an interior or inner surface or wall, extending from the upper surface 2052 toward the lower surface 2054 of the cable guard. The cable facing surface 2005 can have any of the geometric configurations of any of the cable guard bores or cable guides explained in any of the other embodiments herein. The bore 2021 can include an axis 2065 which can be generally parallel to the bowstring when the bowstring is in an undrawn state, as with other embodiments herein.

The cable facing surface 2005 can include one ore more rounded portions. These rounded portions can be the curved, rounded or radiused ingress and/or egress regions 2032A 2033A as shown in FIG. 48. Generally, the rounded portions can form a transition surface between the upper and lower surfaces and the interior of the bore or recess. The rounded portion can be of any of the geometric configurations and have the characteristics of any of the rounded portions described in the embodiments herein.

The cable facing surface 2005 can be constructed from metal. Indeed, the entire cable guard 2010 can be constructed from metal. Suitable metals include any of the metals herein, for example aluminum, aluminum alloys, titanium, steel, and the like. Constructing these elements from metal can promote the electrodeposition of an e-coat film as described below.

Figure 47:
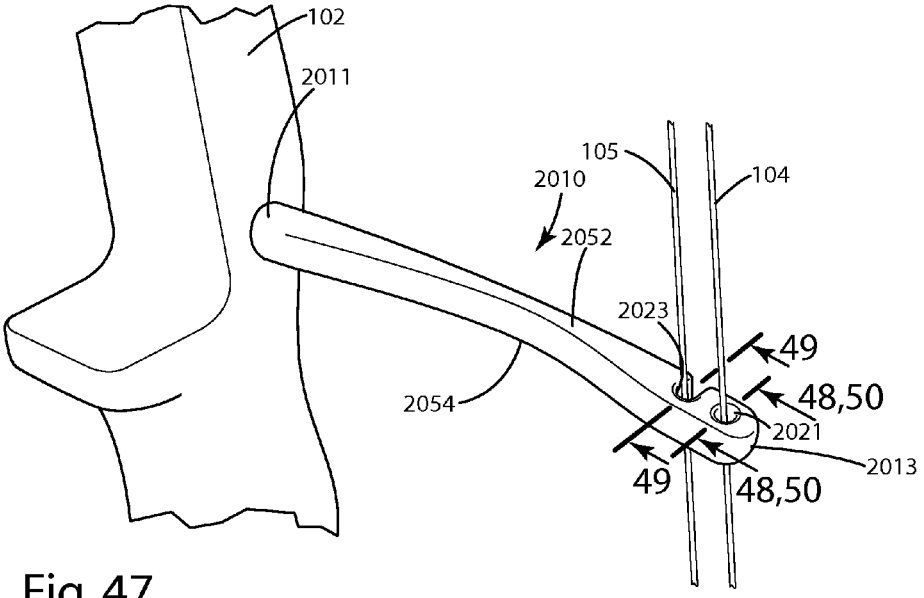
FIG. 47 is perspective view of a twentieth alternative embodiment of the cable guard.
Figure 49:
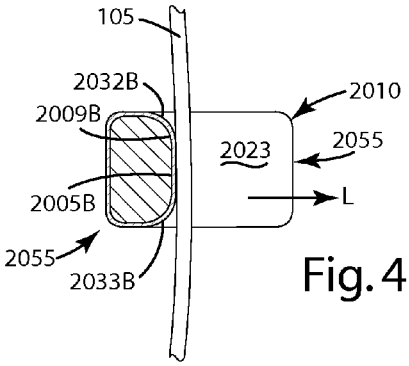
FIG. 49 is a cross sectional view of the twentieth alternative embodiment of the cable guard taken along line 49-49 of FIG. 47.

As shown in FIGS. 47 and 49, the cable guard 2010 can define a recess 2023. Generally, the recess can be in the shape of a "V", a "U", a "C," or generally in the shape of a channel so that the cable 105 can be removed laterally or otherwise in direction L from the recess 2023 (FIG. 49). This construction can facilitate removal, maintenance and inspection of the cables and/or the cable guard.

The cable recess 2023 can be configured similar to that of the cable guard bore 2021. For example, the cable recess can include a cable facing surface 2005B which can include one or more rounded ingress and egress regions 2032B and 2033B as described in connection with those surfaces in connection with FIG. 48. The cable facing surface 2005B, can also extend from the upper surface 2052 to the lower surface 2054 of the cable guard. Further, the cable recess can include an e-coat film as described further below.

The e-coat film 2009, 2009B shown in FIGS. 48 and 49 can be an electro-deposited layer that is joined directly with the cable facing surface 2005, 2005B. The e-coat film can have the properties of extreme surface smoothness, lubricity and durability. The e-coat film can minimize and actually eliminate abrasion and/or wear of the cables or other components that contact or are adjacent the cable facing surface or otherwise are guided by the cable guard or cable guides in the embodiments herein. The e-coat film can be disposed in those areas that are in contact or potential contact with the cables 104 and 105. The e-coat film can be of a substantially uniform film thickness. The thickness T10 of the e-coat film can be in the range of about 0.0002 inches to about 0.0010 inches. This thickness range can be helpful where close tolerances are used in assembling and manufacturing components of the archery bow. The e-coat film can be constructed from an epoxy material and/or a acrylic material depending on the particular application, as described below.

Turning to FIGS. 48 and 49, the e-coat film 2009, 2009B is disposed over the metal facing surface 2005 and 2005B. The e-coat film extends upwardly over the rounded portions of the cable facing surface in the bore and recess. Optionally, the e-coat film can also extend over the upper surfaces 2052 and lower surfaces 2054, as well as any other outer surfaces 2055 of the cable guard 2010. In some applications, to apply the e-coat film 2009, 2009B, the entire cable guard 2010 can be immersed in the respective bath of charged particles of the acrylic material and/or epoxy material.

Figure 50:
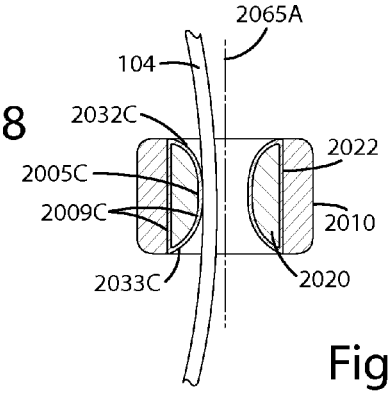
FIG. 50 is a cross sectional view of a modification of the twentieth alternative embodiment of the cable guard taken along line 48, 50-48, 50 of FIG. 47.

FIG. 50 illustrates a modified version of the twentieth alternative embodiment. Generally, this embodiment includes a cable guard 2010 and a cable guide insert or element 2020 disposed in a bore 2022 of the cable guard 2010. The cable guide insert 2020 can include a cable facing surface 2005C which is similar to that of the cable facing surfaces 2005, 2005B in FIGS. 48 and 49. The cable facing surface 2005C can include rounded portions 2032C and 2033C as with the other embodiments described above in connection with FIGS. 48 and 49. The insert 2020 can be constructed from a metal, such as those explained above. The e-coat film 2009C can be coated over the cable facing surface 2005C as well as any other surfaces of the insert as illustrated. The insert 2020 can be secured in the bore 2022 of the cable guard 2010 with cement, glue, a fastener, a pressure fit, or any of the other constructions noted herein for attaching inserts to the cable guard.

The cable guard and its structural components, such as the cable bore 2021 and recess 2023, the respective ends 2011, 2013 and/or inserts 2020 can be manufactured using any of the techniques described in the embodiments above, however, in addition, an e-coat film can be included on the cable facing or other surface.

A process for making and/or transforming a cable guard so that its surface includes an e-coat film will now be described. To apply the e-coat film, an e-coating process is used. E-coating, also referred to as electro-coating or electrophoretic coating, is a method of coating or painting that uses an electrical current to deposit the paint or coating materials. More specifically, e-coating is performed by applying an electrical current to a metal part while the part is immersed in a bath of charged particles. The e-coat film thickness resulting from the e-coating process is directly related to the applied voltage. For example, the higher the voltage, the greater the thickness of the film.

The e-coat process generally has a self-limiting control. For example, as charged particles of the coating or paint material are electro-deposited on a surface in an area, the resistance in that area increases until the applied voltage can no longer overcome the resistance. At that point, the coating buildup ceases in that particular area. Buildup of the coating will, however, continue in other areas of the part until all areas of the part are covered with the uniform thickness of the coating, including interior surfaces. The coating thickness, and ultimately the end result e-coat film thickness will generally range between 0.0002 inches to about 0.0010 inches. This very minimal thickness can be helpful where close part tolerances are used in assembly of the archery components to which the e-coat film is applied.

Generally, the process for e-coating the cable guard, selected surfaces thereof, or the surfaces of any archery component for that matter, includes the steps of: (a) pretreatment, (b) an e-coating bath, (c) a post rinse, and (d) curing of the e-coat film. Pretreatment includes cleaning and rinsing of a part to remove residual foreign material in preparation for the conversion coating.

The e-coating bath includes the applying of a voltage or charge to the metal surface of the part, for example, the cable facing surface 2005, and optionally to the entire cable guard 2010. The metal facing surface and/or entire cable guard are immersed in a bath of oppositely charged particles of at least one epoxy material and an acrylic material, depending on the particular application. The charged particles electro-deposit to provide a coating of the materials on the metal cable facing surface.

After electrodeposition of these materials on the metal facing surface, the part can be rinsed to remove an residual material clinging to the part that was not deposited in the e-coating bath. After the electro-depositing and optional post-rinse, the coating can be cured. In curing, the coating can become an e-coat film. The curing can include thermal curing or baking. The polymeric materials, for example, the epoxy materials and/or the acrylic materials used in the coating can crosslink. Generally, without curing, the coating is porous due to the evolution of gas during electrodeposition. With the cross linking and curing, the coating flows out and becomes smooth and continuous, which contributes to the low friction, lubricious, smooth properties of the finished e-coat film.

Figure 51:
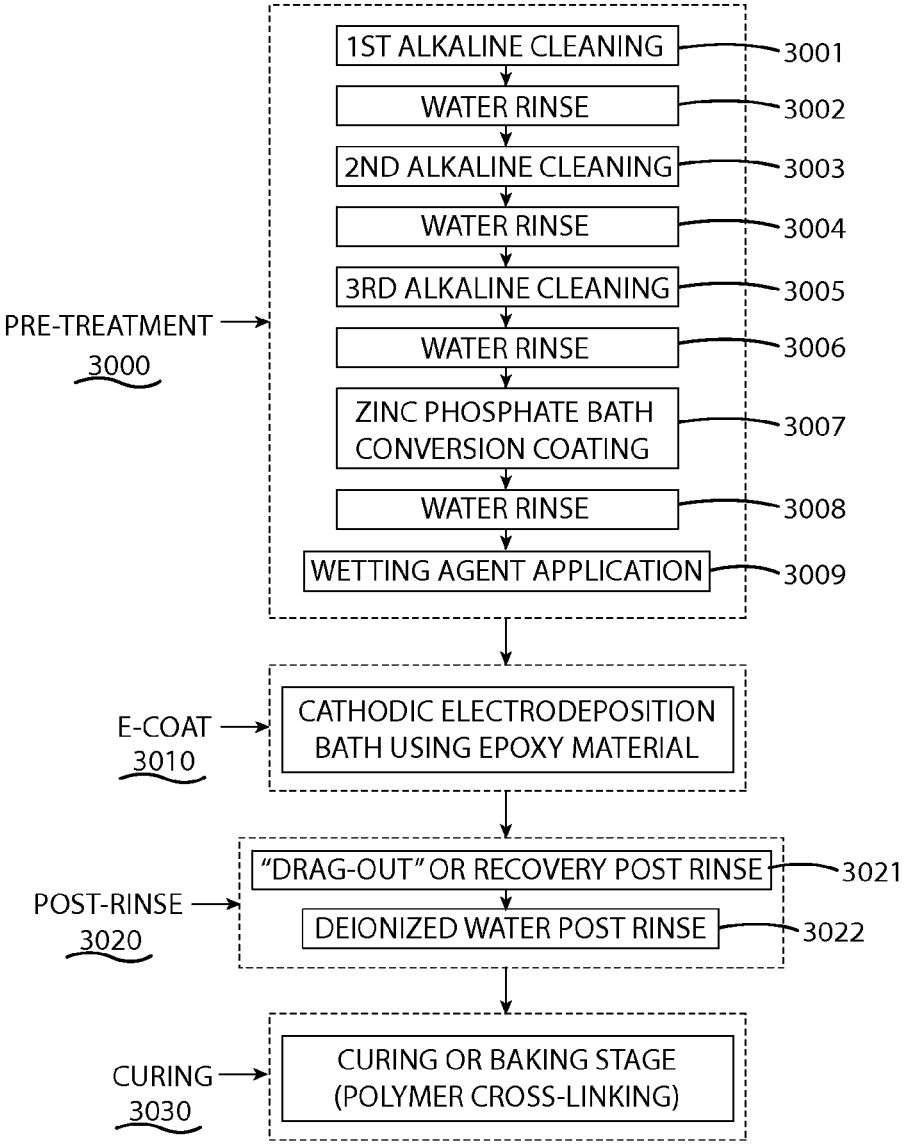
FIG. 51 is a flow chart illustrating an exemplary electrocoating process for use with the embodiments herein.

An example of a particular electro-coating process for use with the current embodiments herein is illustrated in FIG. 51. As shown there, the exemplary process includes the steps of pretreatment 3000, e-coating 3010, post-rinsing and curing 3030. Pretreatment 3000 can include several sub-steps which can vary depending on the facility performing the processing and the condition of the product to be e-coated. The cleaning and rinsing sub-steps 3001-3006 can remove any residual foreign material remaining in preparation for the electrodeposition. Operating parameters can be computer controlled and adjusted specifically for the product to be e-coated. With reference to applying an e-coat film to a cable guard 2010, or more particularly to a cable facing surface 2005, 2005B, 2005C, the cable guard and its surfaces can be cleaned first in an alkaline cleaner in sub-step 3001, rinsed in sub-step 3002, re-cleaned with an alkaline cleaner in sub-step 3003, rinsed again in sub-step 3004, cleaned again in another alkaline material and then water rinsed again in step 3006.

The cleaning and rinsing can occur in one or more suitable tanks of the respective liquid. Generally, the alkaline cleaners can be applied via spray cleaners for about one and half minutes at a suitable temperature, for example, about 70° F. to about 120° F. Alternatively, the cleaners can be applied via an immersion of the cable guard and respective cable facing surface for two minutes or more in a particular cleaner. The conditions in each of the respective cleaning tanks and rinses, such as pH and molarity, as well as the particular chemicals being used, can determine the respective temperatures and durations in the various sub-steps. One exemplary alkaline material used for cleaning can be a high pH (pH 7.5-11) sodium hydroxide or other basic/alkaline material. As an alternative to an alkaline bath and rinse, the part can be washed in an acidic bath and likewise rinsed. At the end of the final rinse, before entering the conversion coating bath, the objective is to have crystal clear water without any evidence of contaminants or residuals from the rinsed part.

In the pretreatment step 3000, a conversion coating, such as a zinc phosphate conversion coating, is applied to the cable guard and its components, for example the cable facing surface. A conversion coating provides an adherent or bonded surface layer by reaction of suitable reagents, such as zinc phosphate, with a metal surface of the cable facing surface and/or cable guard. Generally, this is a chemical oxidation-reduction reaction. In cases where the cable guard is constructed from steel or iron, the conversion coating can retard corrosion under the e-coat film and improve adhesion for these finishes.

There are at least three phosphate coatings that can be used, for example, zinc phosphate, iron phosphate and manganese phosphate. Where the cable guard is constructed from aluminum or an aluminum alloy, a zinc phosphate can be used. The zinc phosphate coating can be applied to yield a conversion coating in the range of about 150 milligrams to about 1500 milligrams per square foot of the coated metal surface.

As shown in the pretreatment step 3000, the zinc phosphate bath is followed by a water rinse 3008 sub-step and a subsequent wetting agent application in sub-step 3009. Suitable wetting agents, such as surfactants, are known to those of skill in the art. The function of the wetting agent is to keep the part wet while it is out of the tank, and also to avoid streaking in the subsequent application of the e-coat coating.

With the pretreatment step 3000 completed, the cable guard, and in particular the cable facing surface, can be e-coated in step 3010. The e-coat step includes electrodeposition of an e-coat material, such as an epoxy material or acrylic material, which materials are known to those with skill in the art, on the cable guard, the cable facing surface, and/or another metal surface of the part. Generally, a direct current charge is applied to the cable facing surface and/or the cable guard, which as mentioned above can be constructed from metal, such as aluminum. The cable guard and in particular the metal cable facing surface, or any other surface intended to be coated with an e-coat film, is immersed in a bath of charged particles being either an epoxy material and/or an acrylic material. The particles of these materials, which generally form the "paint" or "coating" are generally oppositely charged from the cable facing surface and/or cable guard. The amount of DC voltage applied can be between 25 and 400 volts, depending on the particular size, application rate, and desired thickness of the resulting e-coat film.

The bath of charged particles that carries the acrylic and/or epoxy materials can include about 75% to about 95%, optionally about 80% to about 90% deionized water; about 5% to about 25%, optionally about 10% to about 20% of the desired epoxy and/or acrylic materials; and a remaining 1% to about 3% of a volatile organic solvent.

In the e-coat step 3010, the cable guard and/or cable facing surface can either become cathodic or anodic. For example, if the part carries the negative charge the e-coating system is considered cathodic. Conversely, if the part is positively charged, it becomes the anode, and the system is considered anodic. In the exemplary process illustrated in FIG. 51, the system becomes. Generally, cathodic systems can exhibit good adhesion performance and corrosion protection, particularly in an outdoor environment. In some anodic systems, there can be a tendency for migration of small amounts of metal ions into the e-coat film, which does not typically occur in cathodic systems. In some cases, the anodic systems can have a lower curing temperature, for example as low as 180° F., compared to around 350-400° F. in a cathodic system. This lower curing temperature can be helpful where components of an assembly might be damaged by higher curing temperatures. Anodic systems also can offer color and gloss control.

In the e-coating step 3010, either an epoxy material or a acrylic material can be applied to the part, for example, the cable guard, cable facing surface or other metal surface of the part. The epoxy material can be used in either a cathodic or an anodic system. As an example, a cathodic epoxy material has good adhesion and corrosion protection properties. It can also be used as a primer for a wide variety of top coats or as a single coat application where UV protection is not a significant consideration. On the other hand, an anodic epoxy material can be used where lower curing temperatures are helpful. While not as good as the cathodic epoxy material for corrosion resistance and adhesion, it nonetheless has very good properties. A cathodic acrylic material can provide good protection against UV degradation, in some cases better than an applied cathodic epoxy material. However, the adhesion properties and corrosion resistance of a cathodic acrylic material are not as good as most cathodic epoxy materials.

In the exemplary process of FIG. 51, the cable guard 2010 carries the negative charge and becomes the cathode, in other words, the cable facing surface becomes cathodic with an electrical current applied to the metal cable facing surface. In the e-coating step 3010, the part being e-coated, for example, the cable guard and in particular its metal surface, is immersed in a bath of epoxy material having positively charged particles. The metal surface is caused to have an electrical charge, for example, a negative charge, so that it becomes the cathode of the system. With the positively charged epoxy material particles and the negatively charged metal surface, the charged coating particles are electro-deposited on the metal surface to provide a coating on the metal surface. A voltage of anywhere from 25 to 400 volts DC can be applied, and optionally voltages of at least 200 volts, at least 250 volts, and further optionally 300 volts, can be applied in the bath to electro-deposit the charged coating particles on the metal surface.

After electrodeposition of the particles of the epoxy material and/or acrylic material on the metal surface in step 3010, the part can be post-rinsed in step 3020. This post rinsing can be performed to remove any residual coating or paint material clinging to the part which was not deposited during the e-coating step 3010. The post rinsing step 3020 can include two or more sub-steps 3021 and 3022. In sub-step 3021 an ultrafine filter is utilized to remove water from the tank in which the electrodeposition bath occurred. In this manner, the materials, for example, the epoxy material or acrylic material particles can be returned to the e-coating bath tank, providing transfer efficiencies in some cases greater than 90%, and optionally greater than 95%. The excess coating and/or paint particles or solids recovered in this process are referred to as "drag out". In sub-step 3022, secondary rinses may utilize appropriate solvents or optionally deionized water, which rinses are known in the art. The deionized water is of the type that has its mineral ions removed. Generally, the coated metal surfaces of the cable guard are simply rinsed with a deionized water two or more times in this sub-step 3022.

After the e-coating step 3010 and the optional post rinsing step 3020 are performed, the coating of the material, for example, the coating particles on the metal surface, can be cured to provide an e-coat film on that metal surface. Curing can be performed via thermo-curing or baking. In the curing step, the epoxy material and/or acrylic material can be chemically modified so that the particles within those polymers crosslink with one another. Such crosslinking can allow the coating, which can be porous due to the evolution of gas during the electrodeposition, to flow out so that the coating becomes a smooth and continuous film.

The time and temperature parameters of the curing can be dependent on the type of material used, the desired thickness of the coating, and the intricacy of the part being coated. Generally, the curing step 3030 can include placing the cable guard, and particularly the metal surface, in an oven so that the temperature of the part can range from about 350-400° F., optionally about 375-380° F. The part can be baked for about 10-30 minutes, optionally about 20 minutes. With the curing completed, the e-coat film is effectively joined with the metal surface, for example the cable facing surface of the cable guard or any other surface. The e-coat film can be located in a region of potential abrasion or wear, for example where the cable and/or bow string of an assembled bow will engage the cable guard or other archery component, and move in relation to that component.

With the cable guard constructed and including the e-coat film, it can be later assembled on an archery bow, and positioned so that the e-coat film engages either a cable, and in some cases with regard to other archery components, a bow string, when the cable and/or bow string moves to reduce and/or wear abrasion of the same.

It is contemplated herein that the above process and resultant e-coat film can be utilized in conjunction with a variety of other archery bow components where those components may contact yet other archery components and have the potential for wear and/or abrasion. In which case, the e-coat film can reduce, impair or prevent such wear and/or abrasion. For example, the above-noted process can be used to transform virtually any archery bow component to provide an e-coat film on a metal surface thereof, where the e-coat film is located in a region of potential abrasion and/or wear. The archery component can be, for example, a cam (as defined herein), a cam axle, a cable guard, a cable guide, a riser, and/or other components of an archery bow, provided the same have some sort of metal surface or other surface that can hold a charge.

To provide the e-coat film on the archery component, the archery component can undergo a process like that in the embodiments above. For example, the metal surface of the archery component can be pretreated, immersed in a bath of charged particles, and the metal surface can be caused to have an electrical charge. The charged coating particles can be electrodeposited on the metal surface to provide a coating on the metal surface. Optionally, the coated metal surface can be post rinsed as described above. The coating can be cured on the metal surface to provide an e-coat film on the metal surface. The e-coat film can be located on the metal surface in a region of potential abrasion and/or wear. Generally, the e-coat film can be engaged in an assembled archery bow with a cable, bowstring or other moving element to reduce abrasion of the cable, bowstring and/or other element.

Figure 52:
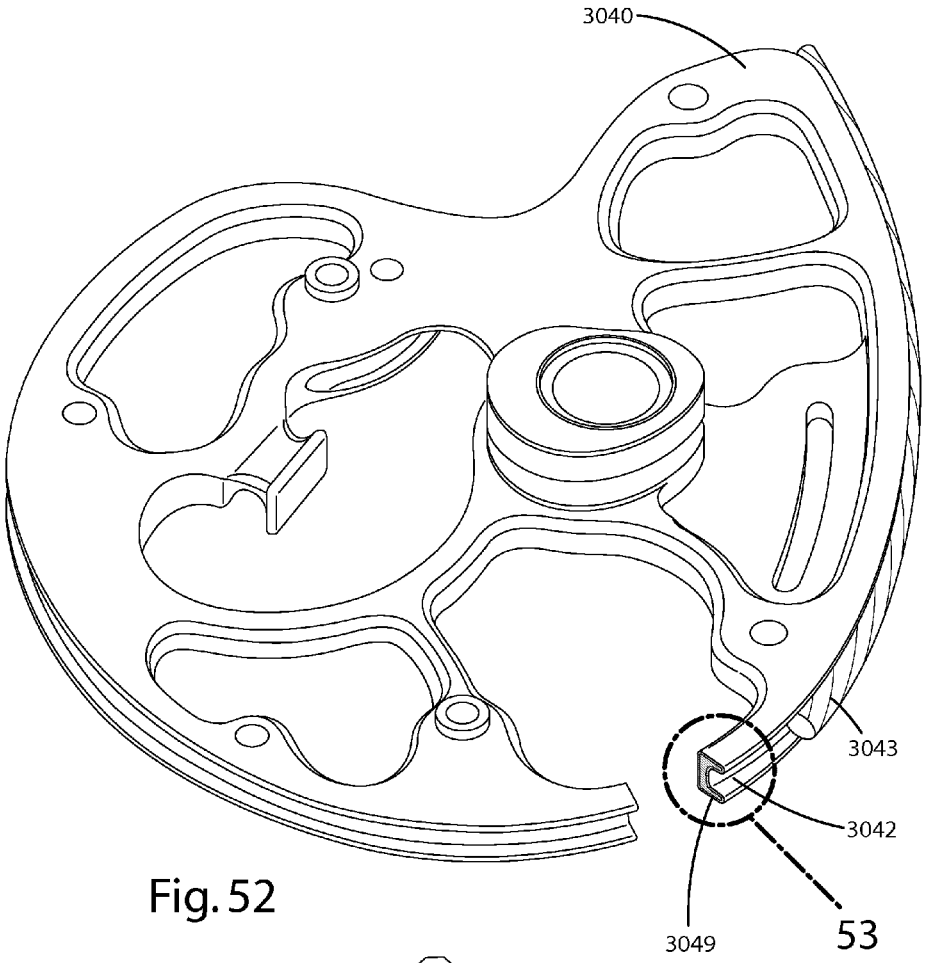
FIG. 52 is a cut-away view of an electrocoated archery component.
Figure 53:
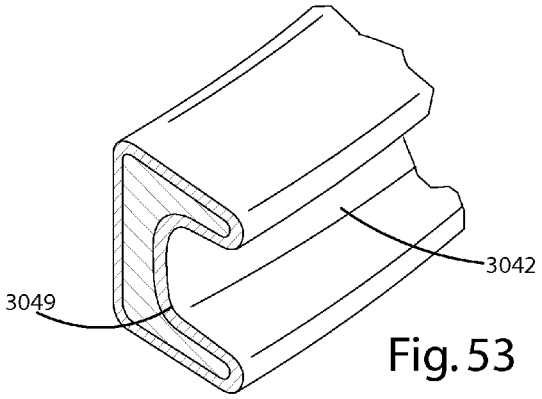
FIG. 53 is an close up view of the archery component taken from region 53 in FIG. 52.

As an example of an archery bow component that includes an e-coat film, a cam is illustrated in FIGS. 52 and 53. The cam 3040 can include a groove 3042 which is configured to receive a bowstring and/or cable 3043 therein. The groove can include an e-coat film 3049 which is included on at least the surface of the groove 3042, for example the rounded portions and/or other portions around the perimeter of the groove that engage or have the potential to engage the cable and/or bowstring 3043. Of course other surfaces of the cam 3040 can be coated with the e-coat film as well. The e-coat film on the cam can be similar to and can function like e-coat films on the cable facing surfaces described above.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A method of transforming a cable guard for an archery bow, comprising:

providing a cable guard including a riser end and a cable end, the riser end configured to join with an archery bow riser, the cable guard of a length sufficient to extend rearwardly from the archery bow riser and provide engagement with a cable of the archery bow when installed on the archery bow, the cable guard at least one of including and being joined with a metal cable facing surface including a rounded portion;

immersing the metal cable facing surface in a bath of charged particles of at least one of an epoxy material and an acrylic material;

causing the metal cable facing surface to have an electrical charge;

electrodepositing the charged particles to provide a coating of the at least one of the epoxy material and the acrylic material on the metal cable facing surface; and curing the coating to provide an e-coat film on the metal cable facing surface, wherein the e-coat film is adapted to engage the cable of the archery bow when the cable moves to reduce at least one of abrasion and wear on the cable.

2. The method of claim 1 wherein the curing includes baking the coating on the metal facing surface so that the at least one of the epoxy material and the acrylic material on the metal cable facing surface cross links.

3. The method of claim 1 wherein the electrodepositing includes electrodepositing the charged particles on the riser end and the cable end to provide a coating of the at least one of the epoxy material and the acrylic material on the riser end and the cable end.

4. The method of claim 1 comprising joining the cable guard with the riser of the archery bow and placing the cable adjacent the e-coat film so that the e-coat film engages the cable.

5. The method of claim 1 wherein the curing includes heating the coating to at least 350° F. to promote cross linking within the coating.

6. The method of claim 1 comprising electrodepositing the charged particles on the metal cable facing surface to produce the e-coat film having a thickness ranging from 0.0002 inches to 0.0010 inches.

7. The method of claim 1 wherein the cable guard is in the form of a generally elongated bar between the riser end and the cable end, wherein the cable guard defines a cable guard bore, and wherein the cable facing surface is located within the cable guard bore.

8. The method of claim 1 wherein the cable guard includes an upper surface and an opposing lower surface, with the metal cable facing surface forming at least one of a cable guard bore and a cable recess, wherein the metal cable facing surface extends generally from the upper surface to the lower surface.

9. The method of claim 8 comprising:

immersing the cable guard upper surface and the lower surface in the bath of charged particles;

causing the cable guard upper surface and the lower surface to have an electrical charge;

electrodepositing the charged particles to provide a coating of the at least one of the epoxy material and the acrylic material on the cable guard upper surface and the lower surface; and curing the coating to provide an e-coat film on the cable guard upper surface and the lower surface.

10. A method for transforming an archery bow component, comprising:

providing an archery bow component including a metal surface, the archery bow component selected from the group consisting of a cam, a cam axle, a cable guard, a cable guide and a riser;

immersing the metal surface in a bath of charged coating particles;

causing the metal surface to have an electrical charge;

electrodepositing the charged coating particles on the metal surface to provide a coating on the metal surface; and curing the coating on the metal surface to provide an e-coat film on the metal surface, wherein the e-coat film is located in a region of potential abrasion or wear on the archery bow component.

11. The method of claim 10 comprising engaging the e-coat film with at least one of a cable and a bowstring of an assembled archery bow when the at least one of the cable and the bowstring moves to reduce at least one of abrasion and wear of the at least one of the cable and the bowstring.

* * * * *